US011754072B2

(12) United States Patent
Doepker et al.

(10) Patent No.: US 11,754,072 B2
(45) Date of Patent: Sep. 12, 2023

(54) COMPRESSOR HAVING CAPACITY MODULATION ASSEMBLY

(71) Applicant: Emerson Climate Technologies, Inc., Sidney, OH (US)

(72) Inventors: Roy J. Doepker, Lima, OH (US); Michael M. Perevozchikov, Tipp City, OH (US)

(73) Assignee: Copeland LP, Sidney, OH (US)

( * ) Notice: Subject to any disclaimer, the term of this patent is extended or adjusted under 35 U.S.C. 154(b) by 169 days.

(21) Appl. No.: 17/196,119

(22) Filed: Mar. 9, 2021

(65) Prior Publication Data

US 2021/0190070 A1 Jun. 24, 2021

Related U.S. Application Data

(63) Continuation of application No. 16/154,844, filed on Oct. 9, 2018, now Pat. No. 10,995,753.

(Continued)

(51) Int. Cl.
*F04C 28/10* (2006.01)
*F04C 29/12* (2006.01)

(Continued)

(52) U.S. Cl.
CPC ..... *F04C 28/10* (2013.01); *F04C 18/0223* (2013.01); *F04C 18/0253* (2013.01);

(Continued)

(58) Field of Classification Search
CPC .. F04C 28/10; F04C 18/0223; F04C 18/0253; F04C 28/24; F04C 28/26; F04C 29/126;

(Continued)

(56) References Cited

U.S. PATENT DOCUMENTS 3,303,988 A 2/1967 Weatherhead
4,058,988 A 11/1977 Shaw (Continued)

FOREIGN PATENT DOCUMENTS

AU 2002301023 B2 6/2005
CN 1137614 A 12/1996

(Continued)

OTHER PUBLICATIONS

Non-Final Office Action regarding U.S. Appl. No. 17/176,080 dated Mar. 30, 2022.

(Continued)

*Primary Examiner* — Kenneth J Hansen
*Assistant Examiner* — David N Brandt
(74) *Attorney, Agent, or Firm* — Harness, Dickey & Pierce, P.L.C.

(57) ABSTRACT

A compressor may include first and second scrolls, and an axial biasing chamber. Spiral wraps of the scrolls mesh with each other and form compression pockets including a suction-pressure compression pocket, a discharge-pressure compression pocket, and intermediate-pressure compression pockets. The axial biasing chamber may be disposed axially between the second end plate and a component. Working fluid disposed within the axial biasing chamber may axially bias the second scroll toward the first scroll. The second end plate includes outer and inner ports. The outer port is disposed radially outward relative to the inner port. The outer port may be open to a first one of the intermediate-pressure compression pockets and in selective fluid communication with the axial biasing chamber. The inner port may be open to a second one of the intermediate-pressure compression pockets and in selective fluid communication with the axial biasing chamber.

21 Claims, 19 Drawing Sheets

Related U.S. Application Data

(60) Provisional application No. 62/672,700, filed on May 17, 2018.

(51) Int. Cl.

| | |
|---|---|
| ***F04C 18/02*** | (2006.01) |
| ***F04C 28/24*** | (2006.01) |
| ***F04C 28/26*** | (2006.01) |
| ***F04C 27/00*** | (2006.01) |

(52) U.S. Cl.

CPC ..... *F04C 28/24* (2013.01); *F04C 28/26* (2013.01); *F04C 29/126* (2013.01); *F04C 27/008* (2013.01); *F04C 2270/185* (2013.01)

(58) Field of Classification Search

CPC ..... F04C 18/0215; F04C 27/008; F04C 2270/18; F04C 2270/185; F16K 99/0048; F16K 99/0046; F16K 99/0042; F16K 99/0028

See application file for complete search history.

(56) References Cited

U.S. PATENT DOCUMENTS 4,216,661 A 8/1980 Tojo et al.
4,382,370 A 5/1983 Suefuji et al.
4,383,805 A 5/1983 Teegarden et al.
4,389,171 A 6/1983 Eber et al.
4,466,784 A 8/1984 Hiraga
4,475,360 A 10/1984 Suefuji et al.
4,475,875 A 10/1984 Sugimoto et al.
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass

(56) References Cited

U.S. PATENT DOCUMENTS 6,293,776 B1 9/2001 Hahn et al.
6,309,194 B1 10/2001 Fraser et al.
6,322,340 B1 11/2001 Itoh et al.
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,514,060 B1 2/2003 Ishiguro et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello
6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,197,890 B2 4/2007 Taras et al.
7,207,787 B2 4/2007 Liang et al.
7,228,710 B2 6/2007 Lifson
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,641,455 B2 1/2010 Fujiwara et al.
7,674,098 B2 3/2010 Lifson
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,025,492 B2 9/2011 Seibel et al.
8,303,278 B2 11/2012 Roof et al.
8,303,279 B2 11/2012 Hahn
8,308,448 B2 11/2012 Fields et al.
8,313,318 B2 11/2012 Stover et al.
8,328,531 B2 12/2012 Milliff et al.
8,393,882 B2 3/2013 Ignatiev et al.
8,506,271 B2 8/2013 Seibel et al.
8,517,703 B2 8/2013 Doepker
8,585,382 B2 11/2013 Akei et al.
8,616,014 B2 12/2013 Stover et al.
8,672,646 B2 3/2014 Ishizono et al.
8,757,988 B2 6/2014 Fukudome et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,080,446 B2 7/2015 Heusler et al.
9,127,677 B2 9/2015 Doepker
9,145,891 B2 9/2015 Kim et al.
9,169,839 B2 10/2015 Ishizono et al.
9,217,433 B2 12/2015 Park et al.
9,228,587 B2 1/2016 Lee et al.
9,249,802 B2 2/2016 Doepker et al.
9,297,383 B2 3/2016 Jin et al.
9,303,642 B2 4/2016 Akei et al.
9,435,340 B2 9/2016 Doepker et al.
9,494,157 B2 11/2016 Doepker
9,541,084 B2 1/2017 Ignatiev et al.
9,556,862 B2 1/2017 Yoshihiro et al.
9,605,677 B2 3/2017 Heidecker et al.
9,624,928 B2 4/2017 Yamazaki et al.
9,638,191 B2 5/2017 Stover
9,651,043 B2 5/2017 Stover et al.
9,777,730 B2 10/2017 Doepker et al.
9,777,863 B2 10/2017 Higashidozono et al.
9,790,940 B2 10/2017 Doepker et al.
9,850,903 B2 12/2017 Perevozchikov
9,869,315 B2 1/2018 Jang et al.
9,879,674 B2 1/2018 Akei et al.
9,885,347 B2 2/2018 Lachey et al.
9,989,057 B2 6/2018 Lochner et al.
10,066,622 B2 9/2018 Pax et al.
10,087,936 B2 10/2018 Pax et al.
10,094,380 B2 10/2018 Doepker et al.
10,428,818 B2 10/2019 Jin et al.
10,563,891 B2 2/2020 Smerud et al.
10,724,523 B2 7/2020 Wu et al.
10,815,999 B2 10/2020 Jeong
10,907,633 B2 2/2021 Doepker et al.
10,954,940 B2 3/2021 Akei et al.
10,974,317 B2 4/2021 Ruxanda et al.
2001/0010800 A1 8/2001 Kohsokabe et al.
2002/0039540 A1 4/2002 Kuroki et al.
2002/0057975 A1 5/2002 Nakajima et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton

(56) References Cited

U.S. PATENT DOCUMENTS

2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0003666 A1 1/2007 Gutknecht et al.
2007/0036661 A1 2/2007 Stover
2007/0110604 A1 5/2007 Peyton
2007/0130973 A1 6/2007 Lifson et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0286118 A1 11/2008 Gu et al.
2008/0305270 A1 12/2008 Uhlianuk et al.
2009/0013701 A1 1/2009 Lifson et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1* 12/2010 Stover ..... F04C 18/0215 165/104.31
2010/0303659 A1 12/2010 Stover et al.
2011/0052437 A1 3/2011 Iitsuka et al.
2011/0135509 A1 6/2011 Fields et al.
2011/0206548 A1 8/2011 Doepker
2011/0243777 A1 10/2011 Ito et al.
2011/0250085 A1 10/2011 Stover et al.
2011/0293456 A1 12/2011 Seibel et al.
2012/0009076 A1 1/2012 Kim et al.
2012/0107163 A1 5/2012 Monnier et al.
2012/0183422 A1 7/2012 Bahmata
2012/0195781 A1 8/2012 Stover et al.
2013/0078128 A1 3/2013 Akei
2013/0089448 A1 4/2013 Ginies et al.
2013/0094987 A1 4/2013 Yamashita et al.
2013/0121857 A1 5/2013 Liang et al.
2013/0177465 A1 7/2013 Clendenin et al.
2013/0195707 A1 8/2013 Ma et al.
2013/0302198 A1 11/2013 Ginies et al.
2013/0309118 A1 11/2013 Ginies et al.
2013/0315768 A1 11/2013 Le Coat et al.
2014/0023540 A1 1/2014 Heidecker et al.
2014/0024563 A1 1/2014 Heidecker et al.
2014/0037486 A1 2/2014 Stover et al.
2014/0134030 A1 5/2014 Stover et al.
2014/0134031 A1 5/2014 Doepker et al.
2014/0147294 A1 5/2014 Fargo et al.
2014/0154121 A1* 6/2014 Doepker ..... F04C 28/16 418/22
2014/0154124 A1 6/2014 Doepker et al.
2014/0219846 A1 8/2014 Ignatiev et al.
2015/0037184 A1 2/2015 Rood et al.
2015/0086404 A1 3/2015 Kiem et al.
2015/0192121 A1 7/2015 Sung et al.
2015/0330386 A1 11/2015 Doepker
2015/0345493 A1 12/2015 Lochner et al.
2015/0354719 A1 12/2015 van Beek et al.
2016/0025093 A1 1/2016 Doepker
2016/0025094 A1 1/2016 Ignatiev et al.
2016/0032924 A1 2/2016 Stover
2016/0047380 A1 2/2016 Kim et al.
2016/0053755 A1 2/2016 Taguchi
2016/0053759 A1 2/2016 Choi et al.
2016/0076543 A1 3/2016 Akei et al.
2016/0115954 A1 4/2016 Doepker et al.
2016/0138879 A1 5/2016 Matsukado et al.
2016/0201673 A1 7/2016 Perevozchikov et al.
2016/0208803 A1 7/2016 Uekawa et al.
2017/0002817 A1 1/2017 Stover
2017/0002818 A1 1/2017 Stover
2017/0030354 A1 2/2017 Stover
2017/0097108 A1* 4/2017 Huff ..... F16K 99/0038
2017/0241417 A1 8/2017 Jin et al.
2017/0268510 A1 9/2017 Stover et al.
2017/0306960 A1 10/2017 Pax et al.
2017/0314558 A1 11/2017 Pax et al.
2017/0342978 A1 11/2017 Doepker
2017/0342983 A1 11/2017 Jin et al.
2017/0342984 A1 11/2017 Jin et al.
2018/0023570 A1 1/2018 Huang et al.
2018/0038369 A1 2/2018 Doepker et al.
2018/0038370 A1 2/2018 Doepker et al.
2018/0066656 A1 3/2018 Perevozchikov et al.
2018/0066657 A1 3/2018 Perevozchikov et al.
2018/0135625 A1 5/2018 Naganuma et al.
2018/0149155 A1 5/2018 Akei et al.
2018/0216618 A1* 8/2018 Jeong ..... F04C 28/26
2018/0223823 A1 8/2018 Ignatiev et al.
2019/0040861 A1 2/2019 Doepker et al.
2019/0101120 A1 4/2019 Perevozchikov et al.
2019/0186491 A1 6/2019 Perevozchikov et al.
2019/0203709 A1 7/2019 Her et al.
2019/0353164 A1 11/2019 Berning et al.
2020/0057458 A1 2/2020 Taguchi
2020/0291943 A1 9/2020 McBean et al.

FOREIGN PATENT DOCUMENTS

CN 1158944 A 9/1997
CN 1158945 A 9/1997
CN 1177681 A 4/1998
CN 1177683 A 4/1998
CN 1259625 A 7/2000
CN 1286358 A 3/2001
CN 1289011 A 3/2001
CN 1339087 A 3/2002
CN 1349053 A 5/2002
CN 1382912 A 12/2002
CN 1407233 A 4/2003
CN 1407234 A 4/2003
CN 1517553 A 8/2004
CN 1601106 A 3/2005
CN 1680720 A 10/2005
CN 1702328 A 11/2005
CN 2747381 Y 12/2005
CN 1757925 A 4/2006
CN 1828022 A 9/2006
CN 1854525 A 11/2006
CN 1963214 A 5/2007
CN 1995756 A 7/2007
CN 101358592 A 2/2009
CN 101684785 A 3/2010
CN 101761479 A 6/2010
CN 101806302 A 8/2010
CN 101910637 A 12/2010
CN 102076963 A 5/2011
CN 102089525 A 6/2011
CN 102272454 A 12/2011
CN 102400915 A 4/2012
CN 102422024 A 4/2012
CN 102449314 A 5/2012
CN 102705234 A 10/2012
CN 102762866 A 10/2012
CN 202926640 U 5/2013
CN 103502644 A 1/2014

(56) References Cited

FOREIGN PATENT DOCUMENTS

| | | | |
|---|---|---|---|
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 209621603 | U | 11/2019 |
| CN | 209654225 | U | 11/2019 |
| CN | 209781195 | U | 12/2019 |
| DE | 3917656 | C2 | 11/1995 |
| DE | 102011001394 | A1 | 9/2012 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 20120008045 | A | 1/2012 |
| KR | 101192642 | B1 | 10/2012 |
| KR | 20120115581 | A | 10/2012 |
| KR | 20130094646 | A | 8/2013 |
| WO | WO-9515025 | A1 | 6/1995 |
| WO | WO-0073659 | A1 | 12/2000 |
| WO | WO-2007046810 | A2 | 4/2007 |
| WO | WO-2008060525 | A1 | 5/2008 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |
| WO | WO-2017071641 | A1 | 5/2017 |

OTHER PUBLICATIONS

First Chinese Office Action & Search Report regarding Application No. 201980040745.1 dated Jan. 6, 2022. English translation provided by Unitalen Attorneys at Law.

Non-Final Office Action regarding U.S. Appl. No. 17/388,923 dated Jun. 9, 2022.

Notice of Allowance regarding U.S. Appl. No. 17/157,588 dated Jun. 16, 2022.

Luckevich, Mark, "MEMS microvalves: the new valve world." Valve World, May 2007, pp. 79-83.

Office Action regarding U.S. Appl. No. 11/522,250, dated Aug. 1, 2007.

Search Report regarding European Patent Application No. 07254962.9, dated Mar. 12, 2008.

Office Action regarding Chinese Patent Application No. 200710153687.2, dated Mar. 6, 2009. Translation provided by CCPIT Patent and Trademark Law Office.

Office Action regarding U.S. Appl. No. 12/103,265, dated May 27, 2009.

Office Action regarding U.S. Appl. No. 11/645,288, dated Nov. 30, 2009.

Office Action regarding U.S. Appl. No. 12/103,265, dated Dec. 17, 2009.

Office Action regarding Korean Patent Application No. 10-2007-0093478, dated Feb. 25, 2010. Translation provided by Y.S. Chang & Associates.

Office Action regarding U.S. Appl. No. 12/103,265, dated Jun. 15, 2010.

Office Action regarding Chinese Patent Application No. 200710160038.5, dated Jul. 8, 2010. Translation provided by Unitalen Attorneys at Law.

Office Action regarding Korean Patent Application No. 10-2007-0093478, dated Aug. 31, 2010. Translation provided by Y.S. Chang & Associates.

Advisory Action regarding U.S. Appl. No. 12/103,265, dated Sep. 17, 2010.

International Search Report regarding International Application No. PCT/US2010/030248, dated Nov. 26, 2010.

Written Opinion of the International Searching Authority regarding International Application No. PCT/US2010/030248, dated Nov. 26, 2010.

International Search Report regarding International Application No. PCT/US2011/025921, dated Oct. 7, 2011.

Written Opinion of the International Search Authority regarding International Application No. PCT/US2011/025921, dated Oct. 7, 2011.

Office Action regarding Chinese Patent Application No. 200710160038.5, dated Jan. 31, 2012. Translation provided by Unitalen Attorneys at Law.

Office Action regarding Chinese Patent Application No. 201010224582.3, dated Apr. 17, 2012. Translation provided by Unitalen Attorneys at Law.

Office Action regarding Indian Patent Application No. 1071/KOL/2007, dated Apr. 27, 2012.

(56) References Cited

OTHER PUBLICATIONS

Office Action regarding U.S. Appl. No. 13/036,529, dated Aug. 22, 2012.
Office Action regarding U.S. Appl. No. 13/181,065, dated Nov. 9, 2012.
International Search Report regarding International Application No. PCT/US2013/051678, dated Oct. 21, 2013.
Written Opinion of the International Searching Authority regarding International Application No. PCT/US2013/051678, dated Oct. 21, 2013.
Office Action regarding Chinese Patent Application No. 201080020243. 1, dated Nov. 5, 2013. Translation provided by Unitalen Attorneys at Law.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.
Office Action regarding Chinese Patent Application No. 201180010366. 1, dated Jun. 4, 2014. Translation provided by Unitalen Attorneys at Law.
Office Action regarding Chinese Patent Application No. 201180010366. 1, dated Dec. 31, 2014. Translation provided by Unitalen Attorneys at Law.
Office Action regarding U.S. Appl. No. 14/081,390, dated Mar. 27, 2015.
Search Report regarding European Patent Application No. 10762374. 6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
International Search Report regarding International Application No. PCT/US2015/042479, dated Oct. 23, 2015.
Written Opinion of the International Searching Authority regarding International Application No. PCT/US2015/042479, dated Oct. 23, 2015.
Office Action regarding Chinese Patent Application No. 201410461048. 2, dated Nov. 30, 2015. Translation provided by Unitalen Attorneys at Law.
Notice of Allowance regarding U.S. Appl. No. 14/060,240, dated Dec. 1, 2015.
Office Action regarding U.S. Appl. No. 14/073,293, dated Jan. 29, 2016.
Office Action regarding Chinese Patent Application No. 201410460792. 0, dated Feb. 25, 2016. Translation provided by Unitalen Attorneys at Law.
Restriction Requirement regarding U.S. Appl. No. 14/060,102, dated Mar. 16, 2016.
Office Action regarding Chinese Patent Application No. 201380059666. 8, dated Apr. 5, 2016. Translation provided by Unitalen Attorneys at Law.
Office Action regarding Chinese Patent Application No. 201380062614. 6, dated Apr. 5, 2016. Translation provided by Unitalen Attorneys at Law.
Advisory Action regarding U.S. Appl. No. 14/073,293, dated Apr. 18, 2016.
Office Action regarding Chinese Patent Application No. 201380062657. 4, dated May 4, 2016. Translation provided by Unitalen Attorneys at Law.
Office Action regarding Chinese Patent Application No. 201380059963. 2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048. 2, dated Jul. 26, 2016. Translation provided by Unitalen Attorneys at Law.
Search Report regarding European Patent Application No. 13858194. 7, dated Aug. 3, 2016.
Search Report regarding European Patent Application No. 13859308. 2, dated Aug. 3, 2016.
Office Action regarding U.S. Appl. No. 14/294,458, dated Aug. 19, 2016.
Office Action regarding Chinese Patent Application No. 201410460792. 0, dated Oct. 21, 2016. Translation provided by Unitalen Attorneys at Law.
Search Report regarding European Patent Application No. 11747996. 4, dated Nov. 7, 2016.
Office Action regarding Chinese Patent Application No. 201380059666. 8, dated Nov. 23, 2016. Translation provided by Unitalen Attorneys at Law.
Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792. 0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191. 7, dated Jun. 13, 2017. Translation provided by Unitalen Attorneys at Law.
Office Action regarding Chinese Patent Application No. 201610516097. 0, dated Jun. 27, 2017. Translation provided by Unitalen Attorneys at Law.
Office Action regarding Indian Patent Application No. 2043/MUMNP/ 2011, dated Jul. 28, 2017.
Restriction Requirement regarding U.S. Appl. No. 14/809,786, dated Aug. 16, 2017.
Office Action regarding U.S. Appl. No. 14/294,458, dated Sep. 21, 2017.
Office Action regarding U.S. Appl. No. 14/757,407, dated Oct. 13, 2017.

(56) References Cited

OTHER PUBLICATIONS

Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys at Law.
Office Action regarding Chinese Patent Application No. 201610512702.7, dated Dec. 20, 2017. Partial translation provided by Unitalen Attorneys at Law.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding Chinese Patent Application No. 201610499158.7, dated Jan. 9, 2018. Translation provided by Unitalen Attorneys at Law.
Office Action regarding U.S. Appl. No. 14/809,786, dated Jan. 11, 2018.
Office Action regarding Chinese Patent Application No. 201580029636.1, dated Jan. 17, 2018. Translation provided by Unitalen Attorneys at Law.
Office Action regarding Chinese Patent Application No. 201580041209.5, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471, dated Feb. 23, 2018.
Office Action regarding Indian Patent Application No. 1907/MUMNP/2012, dated Feb. 26, 2018.
Restriction Requirement regarding U.S. Appl. No. 15/186,092, dated Apr. 3, 2018.
Restriction Requirement regarding U.S. Appl. No. 15/784,458, dated Apr. 5, 2018.
Office Action regarding Korean Patent Application No. 10-2016-7034539, dated Apr. 11, 2018. Translation provided by Y.S. Chang & Associates.
Office Action regarding U.S. Appl. No. 15/186,151, dated May 3, 2018.
Office Action regarding Chinese Patent Application No. 201610930347.5, dated May 14, 2018. Translation provided by Unitalen Attorneys at Law.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610158216.X, dated Jun. 13, 2018. Translation provided by Unitalen Attorneys at Law.
Office Action regarding European Patent Application No. 13859308.2, dated Jun. 22, 2018.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding U.S. Appl. No. 15/784,540, dated Jul. 17, 2018.
Office Action regarding U.S. Appl. No. 15/784,458, dated Jul. 19, 2018.
Restriction Requirement regarding U.S. Appl. No. 15/587,735, dated Jul. 23, 2018.
Office Action regarding Chinese Patent Application No. 201610499158.7, dated Aug. 1, 2018. Translation provided by Unitalen Attorneys at Law.
Interview Summary regarding U.S. Appl. No. 15/186,092, dated Aug. 14, 2018.
Office Action regarding U.S. Appl. No. 15/187,225, dated Aug. 27, 2018.
Office Action regarding Chinese Patent Application No. 201710795228.8, dated Sep. 5, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding Indian Patent Application No. 1307/MUMNP/2015, dated Sep. 12, 2018.
Office Action regarding Chinese Patent Application No. 201580029636.1, dated Oct. 8, 2018. Translation provided by Unitalen Attorneys at Law.
Office Action regarding U.S. Appl. No. 15/587,735, dated Oct. 9, 2018.
Office Action regarding U.S. Appl. No. 15/186,151, dated Nov. 1, 2018.
Office Action regarding Korean Patent Application No. 10-2017-7033995, dated Nov. 29, 2018. Translation provided by Ks Koryo International IP Law Firm.
Notice of Allowance regarding U.S. Appl. No. 15/186,092, dated Dec. 20, 2018.
Office Action regarding Indian Patent Application No. 1306/MUMNP/2015, dated Dec. 31, 2018.
Notice of Allowance regarding U.S. Appl. No. 15/187,225, dated Jan. 3, 2019.
Office Action regarding Chinese Patent Application No. 201610499158.7, dated Feb. 1, 2019. Translation provided by Unitalen Attorneys at Law.
Notice of Allowance regarding U.S. Appl. No. 15/784,458, dated Feb. 7, 2019.
Notice of Allowance regarding U.S. Appl. No. 15/784,540, dated Feb. 7, 2019.
Search Report regarding European Patent Application No. 18198310.7, dated Feb. 27, 2019.
Notice of Allowance regarding U.S. Appl. No. 15/186,151, dated Mar. 19, 2019.
Notice of Allowance regarding U.S. Appl. No. 15/186,092, dated Apr. 19, 2019.
Office Action regarding Chinese Patent Application No. 201710795228.8, dated Apr. 29, 2019. Translation provided by Unitalen Attorneys at Law.
Notice of Allowance regarding U.S. Appl. No. 15/187,225, dated May 2, 2019.
Office Action regarding U.S. Appl. No. 15/587,735, dated May 17, 2019.
Office Action regarding Chinese Patent Application No. 201811011292.3, dated Jun. 21, 2019. Translation provided by Unitalen Attorneys at Law.
Office Action regarding European Patent Application No. 11747996.4, dated Jun. 26, 2019.
Notice of Allowance regarding U.S. Appl. No. 15/186,151, dated Jul. 25, 2019.
Office Action regarding Chinese Patent Application No. 201610499158.7, dated Aug. 1, 2019. Translation provided by Unitalen Attorneys at Law.
Office Action regarding Chinese Patent Application No. 201811168307.7, dated Aug. 12, 2019. Translation provided by Unitalen Attorneys at Law.
Restriction Requirement regarding U.S. Appl. No. 15/682,599, dated Aug. 14, 2019.
Notice of Allowance regarding U.S. Appl. No. 15/587,735, dated Aug. 23, 2019.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding Chinese Patent Application No. 201780055443.2, dated Sep. 2, 2019. Translation provided by Unitalen Attorneys at Law.
Office Action regarding U.S. Appl. No. 15/692,844, dated Sep. 20, 2019.

(56) References Cited

OTHER PUBLICATIONS

Office Action regarding Chinese Patent Application No. 201710795228.8, dated Oct. 28, 2019. Translation provided by Unitalen Attorneys at Law.
Office Action regarding European Patent Application No. 11747996.4, dated Nov. 5, 2019.
Notice of Allowance regarding U.S. Appl. No. 15/186,151, dated Nov. 14, 2019.
Office Action regarding Indian Patent Application No. 2043/MUMNP/2011, dated Nov. 27, 2019.
Office Action regarding Chinese Patent Application No. 201811480347.5, dated Jan. 10, 2020. Translation provided by Unitalen Attorneys at Law.
Office Action regarding Chinese Patent Application No. 201811541653.5, dated Jan. 10, 2020. Translation provided by Unitalen Attorneys at Law.
Office Action regarding European Patent Application No. 11747996.4, dated Jan. 14, 2020.
Office Action regarding U.S. Appl. No. 15/881,016, dated Jan. 23, 2020.
Office Action regarding U.S. Appl. No. 15/682,599, dated Jan. 24, 2020.
Office Action regarding U.S. Appl. No. 15/831,423, dated Jan. 31, 2020.
Notice of Allowance regarding U.S. Appl. No. 15/692,844, dated Feb. 20, 2020.
Office Action regarding European Patent Application No. 13859308.2, dated Mar. 4, 2020.
Office Action regarding Chinese Patent Application No. 201811168307.7, dated Mar. 27, 2020. Translation provided by Unitalen Attorneys at Law.
Office Action regarding Korean Patent Application No. 10-2018-0159231, dated Apr. 7, 2020. Translation provided by KS KORYO International IP Law Firm.
Office Action regarding Chinese Patent Application No. 201780055443.2, dated Apr. 14, 2020. Translation provided by Unitalen Attorneys at Law.
Notice of Allowance regarding U.S. Appl. No. 15/682,599, dated Apr. 22, 2020.
Notice of Allowance regarding U.S. Appl. No. 15/831,423, dated May 20, 2020.
Notice of Allowance regarding U.S. Appl. No. 15/692,844, dated Jun. 4, 2020.
Restriction Requirement regarding U.S. Appl. No. 16/147,920, dated Jun. 25, 2020.
Office Action regarding U.S. Appl. No. 16/154,406, dated Jun. 29, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Restriction Requirement regarding U.S. Appl. No. 16/154,844, dated Jul. 2, 2020.
Office Action regarding Chinese Patent Application No. 201811480347.5, dated Jul. 21, 2020. Translation provided by Unitalen Attorneys at Law.
Office Action regarding U.S. Appl. No. 15/881,016, dated Jul. 21, 2020.
Office Action regarding U.S. Appl. No. 16/177,902, dated Jul. 23, 2020.
Office Action regarding U.S. Appl. No. 16/147,920, dated Sep. 25, 2020.
Notice of Allowance regarding U.S. Appl. No. 16/154,406, dated Oct. 2, 2020.
Office Action regarding U.S. Appl. No. 16/154,844, dated Oct. 5, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; *How and Why we use Capacity Control*; dated Jan. 17, 2016; 12 Pages.
Advisory Action regarding U.S. Appl. No. 17/176,080 dated Oct. 17, 2022.
Performance of the Use of Plastics in Oil-Free Scroll Compressors, Shaffer et al., 2012.

* cited by examiner

COMPRESSOR HAVING CAPACITY MODULATION ASSEMBLY

CROSS-REFERENCE TO RELATED APPLICATIONS

This application is a continuation of U.S. patent application Ser. No. 16/154,844, filed on Oct. 9, 2018, which claims the benefit of U.S. Provisional Application No. 62/672,700, filed on May 17, 2018. The entire disclosures of the above applications are incorporated herein by reference.

FIELD

The present disclosure relates to a compressor having a capacity modulation assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

The present disclosure provides a compressor that may include a first scroll, a second scroll, an axial biasing chamber, a first valve, and a second valve. The first scroll may include a first end plate and a first spiral wrap extending from the first end plate. The second scroll may include a second end plate and a second spiral wrap extending from the second end plate. The first and second spiral wraps mesh with each other and form a plurality of compression pockets therebetween. The compression pockets include a suction-pressure compression pocket, a discharge-pressure compression pocket at a higher pressure than the suction-pressure pocket, and a plurality of intermediate-pressure compression pockets at respective pressures between the pressures of the suction and discharge compression pockets. The second end plate includes an outer port and an inner port. The outer port is disposed radially outward relative to the inner port. The outer port may be open to (i.e., in fluid communication with) a first one of the intermediate-pressure compression pockets. The inner port may be open to (i.e., in fluid communication with) a second one of the intermediate-pressure compression pockets. The axial biasing chamber may be disposed axially between the second end plate and a component. The component may partially define the axial biasing chamber. Working fluid disposed within the axial biasing chamber may axially bias the second scroll toward the first scroll. The first valve may be movable between a first position allowing fluid communication between the inner port and the axial biasing chamber and a second position preventing fluid communication between the inner port and the axial biasing chamber. The second valve may be movable between a first position allowing fluid communication between the outer port and the axial biasing chamber and a second position preventing fluid communication between the outer port and the axial biasing chamber.

In some configurations, the component could be a floating seal assembly, a component of a shell assembly (e.g., an end cap or a transversely extending partition separating a suction-pressure region from a discharge chamber), a bearing housing, etc.

In some configurations of the compressor of any one or more of the above paragraphs, the first scroll is an orbiting scroll, and the second scroll is a non-orbiting scroll.

In some configurations of the compressor of any one or more of the above paragraphs, the first valve is in the first position when the second valve is in the second position.

In some configurations of the compressor of any one or more of the above paragraphs, the first valve is in the second position when the second valve is in the first position.

In some configurations of the compressor of any one or more of the above paragraphs, the compressor includes a capacity modulation assembly configured to switch the compressor between a first capacity mode and a second capacity mode that is lower than the first capacity mode.

In some configurations of the compressor of any one or more of the above paragraphs, when the compressor is in the first capacity mode, the first valve is in the second position and the second valve is in the first position.

In some configurations of the compressor of any one or more of the above paragraphs, when the compressor is in the second capacity mode, the first valve is in the first position and the second valve is in the second position.

In some configurations of the compressor of any one or more of the above paragraphs, the second end plate includes one or more modulation ports in fluid communication with one or more of the intermediate-pressure compression pockets.

In some configurations of the compressor of any one or more of the above paragraphs, the capacity modulation assembly could include a vapor-injection system for injecting working fluid into one of more of the modulation ports.

In some configurations of the compressor of any one or more of the above paragraphs, the one or more modulation ports may be in fluid communication with a suction-pressure region of the compressor when the compressor is in the second capacity mode.

In some configurations of the compressor of any one or more of the above paragraphs, the capacity modulation assembly includes a valve ring disposed between the component and the second end plate and is movable relative to the component and the second end plate between a first position in which the valve ring blocks fluid communication between the one or more modulation ports and the suction-pressure region and a second position in which the valve ring is spaced apart from the second end plate to allow fluid communication between the one or more modulation ports and the suction-pressure region.

In some configurations of the compressor of any one or more of the above paragraphs, the capacity modulation assembly includes a lift ring at least partially disposed within an annular recess in the valve ring. The lift ring and the valve ring may cooperate to define a modulation control chamber that is in selective fluid communication with the suction-pressure region and in selective fluid communication with the axial biasing chamber.

In some configurations of the compressor of any one or more of the above paragraphs, the axial biasing chamber is disposed axially between the valve ring and the component.

In some configurations of the compressor of any one or more of the above paragraphs, the first and second valves are mounted to the valve ring. The first and second valves are movable with the valve ring and are movable relative to the valve ring.

In some configurations of the compressor of any one or more of the above paragraphs, the first and second valves are in contact with the component during at least a portion of a movement of the valve ring toward its second position. Further movement of the valve ring into its second position forces the first valve into its first position and forces the second valve into its second position.

In some configurations of the compressor of any one or more of the above paragraphs, movement of the valve ring toward its first position allows movement of the first valve toward its second position and movement of the second valve toward its first position. A spring may bias the first valve toward its second position.

In some configurations of the compressor of any one or more of the above paragraphs, a pressure differential between the outer port and the axial biasing chamber moves the second valve into its first position as the valve ring moves toward its first position.

In some configurations of the compressor of any one or more of the above paragraphs, the first valve is fluidly connected to the inner port by a first tube that extends partially around an outer periphery of the second end plate. The second valve may be fluidly connected to the outer port by a second tube that extends partially around the outer periphery of the second end plate.

The present disclosure also provides a compressor that may include a first scroll, a second scroll, and an axial biasing chamber. The first scroll may include a first end plate and a first spiral wrap extending from the first end plate. The second scroll may include a second end plate and a second spiral wrap extending from the second end plate. The first and second spiral wraps mesh with each other and form a plurality of compression pockets therebetween. The compression pockets include a suction-pressure compression pocket, a discharge-pressure compression pocket at a higher pressure than the suction-pressure pocket, and a plurality of intermediate-pressure compression pockets at respective pressures between the pressures of the suction and discharge compression pockets. The axial biasing chamber may be disposed axially between the second end plate and a component. The component may partially define the axial biasing chamber. Working fluid disposed within the axial biasing chamber may axially bias the second scroll toward the first scroll. The second end plate includes an outer port and an inner port. The outer port is disposed radially outward relative to the inner port. The outer port may be open to (i.e., in fluid communication with) a first one of the intermediate-pressure compression pockets and may be in selective fluid communication with the axial biasing chamber. The inner port may be open to (i.e., in fluid communication with) a second one of the intermediate-pressure compression pockets and may be in selective fluid communication with the axial biasing chamber.

In some configurations of the compressor of the above paragraph, the compressor includes a first valve movable between a first position allowing fluid communication between the inner port and the axial biasing chamber and a second position preventing fluid communication between the inner port and the axial biasing chamber.

In some configurations of the compressor of any one or more of the above paragraphs, the compressor includes a second valve movable between a first position allowing fluid communication between the outer port and the axial biasing chamber and a second position preventing fluid communication between the outer port and the axial biasing chamber.

In some configurations of the compressor of any one or more of the above paragraphs, the first valve is in the first position when the second valve is in the second position. The first valve is in the second position when the second valve is in the first position.

In some configurations of the compressor of any one or more of the above paragraphs, the first valve is fluidly connected to the inner port by a first tube that extends partially around an outer periphery of the second end plate. The second valve may be fluidly connected to the outer port by a second tube that extends partially around the outer periphery of the second end plate.

In some configurations of the compressor of any one or more of the above paragraphs, the compressor includes a capacity modulation assembly configured to switch the compressor between a first capacity mode and a second capacity mode that is lower than the first capacity mode.

In some configurations of the compressor of any one or more of the above paragraphs, when the compressor is in the first capacity mode, the inner port is fluidly isolated from the axial biasing chamber and the outer port is in fluid communication with the axial biasing chamber.

In some configurations of the compressor of any one or more of the above paragraphs, when the compressor is in the second capacity mode, the outer port is fluidly isolated from the axial biasing chamber and the inner port is in fluid communication with the axial biasing chamber.

In some configurations of the compressor of any one or more of the above paragraphs, the second end plate includes one or more modulation ports in fluid communication with one or more of the intermediate-pressure compression pockets.

In some configurations of the compressor of any one or more of the above paragraphs, the capacity modulation assembly could include a vapor-injection system for injecting working fluid into one of more of the modulation ports.

In some configurations of the compressor of any one or more of the above paragraphs, the one or more modulation ports may be in fluid communication with a suction-pressure region of the compressor when the compressor is in the second capacity mode.

In some configurations of the compressor of any one or more of the above paragraphs, the capacity modulation assembly includes a valve ring disposed between the component and the second end plate and is movable relative to the component and the second end plate between a first position in which the valve ring blocks fluid communication between the one or more modulation ports and the suction-pressure region and a second position in which the valve ring is spaced apart from the second end plate to allow fluid communication between the one or more modulation ports and the suction-pressure region.

In some configurations of the compressor of any one or more of the above paragraphs, the capacity modulation assembly includes a lift ring at least partially disposed within an annular recess in the valve ring. The lift ring and the valve ring may cooperate to define a modulation control chamber that is in selective fluid communication with the suction-pressure region and in selective fluid communication with the axial biasing chamber.

In some configurations of the compressor of any one or more of the above paragraphs, movement of the valve ring toward its first position provides clearance between the component and the first and second valves, and wherein a spring biases the first valve toward its second position.

In some configurations of the compressor of any one or more of the above paragraphs, a pressure differential between the outer port and the axial biasing chamber moves the second valve into its first position as the valve ring moves toward its first position.

In some configurations of the compressor of any one or more of the above paragraphs, the axial biasing chamber is disposed axially between the valve ring and the component.

In some configurations of the compressor of any one or more of the above paragraphs, the component could be a floating seal assembly, a component of a shell assembly (e.g., an end cap or a transversely extending partition separating a suction-pressure region from a discharge chamber), a bearing housing, etc.

In some configurations of the compressor of any one or more of the above paragraphs, the first scroll is an orbiting scroll, and the second scroll is a non-orbiting scroll.

In some configurations of the compressor of any one or more of the above paragraphs, the compressor may include a valve assembly in communication with the axial biasing chamber. The valve assembly may include a valve member movable between a first position providing fluid communication between the outer port and the axial biasing chamber and a second position providing fluid communication between the inner port and the axial biasing chamber.

In some configurations of the compressor of any one or more of the above paragraphs, the valve member includes a first aperture and a second aperture. When the valve member is in the first position, communication between the inner port and the first aperture is blocked and the second aperture is in communication with the outer port. When the valve member is in the second position, communication between the outer port and the second aperture is blocked and the first aperture is in communication with the inner port.

In some configurations of the compressor of any one or more of the above paragraphs, the compressor may include a capacity modulation assembly configured to switch the compressor between a first capacity mode and a second capacity mode that is lower than the first capacity mode. When the compressor is in the first capacity mode, the inner port is fluidly isolated from the axial biasing chamber and the outer port is in fluid communication with the axial biasing chamber. When the compressor is in the second capacity mode, the outer port is fluidly isolated from the axial biasing chamber and the inner port is in fluid communication with the axial biasing chamber.

In some configurations of the compressor of any one or more of the above paragraphs, the second end plate includes one or more modulation ports in fluid communication with one or more of the intermediate-pressure compression pockets. The one or more modulation ports are in fluid communication with a suction-pressure region of the compressor when the compressor is in the second capacity mode. The capacity modulation assembly includes a valve ring disposed between the component and the second end plate and is movable relative to the component and the second end plate between a first position in which the valve ring blocks fluid communication between the one or more modulation ports and the suction-pressure region and a second position in which the valve ring is spaced apart from the second end plate to allow fluid communication between the one or more modulation ports and the suction-pressure region. The capacity modulation assembly includes a lift ring at least partially disposed within an annular recess in the valve ring. The lift ring and the valve ring cooperate to define a modulation control chamber that is in selective fluid communication with the suction-pressure region and in selective fluid communication with the axial biasing chamber.

In some configurations of the compressor of any one or more of the above paragraphs, the valve member includes a third aperture and a fourth aperture, wherein the third aperture is in fluid communication with the first aperture. When the valve member is in the first position: the first aperture and the third aperture are blocked from fluid communication with the axial biasing chamber and the modulation control chamber, the second aperture provides fluid communication between the outer port and the axial biasing chamber, and the fourth aperture provides fluid communication between the suction-pressure region and the modulation control chamber.

In some configurations of the compressor of any one or more of the above paragraphs, when the valve member is in the second position: the first aperture and the third aperture are in fluid communication with the axial biasing chamber and the modulation control chamber, fluid communication is blocked between the second aperture and the outer port and between the second aperture and the axial biasing chamber, fluid communication is blocked between the fourth aperture and the suction-pressure region and between the fourth aperture and the modulation control chamber, and fluid communication between suction-pressure region and the modulation control chamber is blocked.

In some configurations of the compressor of any one or more of the above paragraphs, the valve assembly is a MEMS microvalve.

The present disclosure also provides a compressor that may include a first scroll, a second scroll, an axial biasing chamber, and a valve assembly. The first scroll includes a first end plate and a first spiral wrap extending from the first end plate. The second scroll includes a second end plate and a second spiral wrap extending from the second end plate. The first and second spiral wraps mesh with each other and form a plurality of compression pockets therebetween. The axial biasing chamber may be disposed axially between the second end plate and a floating seal assembly. The floating seal assembly at least partially defines the axial biasing chamber. The valve assembly is in communication with the axial biasing chamber and is movable between a first position providing fluid communication between a first pressure region and the axial biasing chamber and a second position providing fluid communication between a second pressure region and the axial biasing chamber. The second pressure region may be at a higher pressure than the first pressure region.

In some configurations, the first pressure region is a first intermediate-pressure compression pocket defined by the first and second spiral wraps, wherein the second pressure region is a second intermediate-pressure compression pocket defined by the first and second spiral wraps, and wherein the second intermediate-pressure compression pocket is disposed radially inward relative to the first intermediate-pressure compression pocket.

In some configurations, the first pressure region is a suction-pressure region.

In some configurations, the second pressure region is a discharge-pressure region. In some configurations, the discharge-pressure region is a discharge passage extending through the second end plate. In other configurations, the discharge-pressure region could be a discharge chamber (discharge muffler), or an innermost pocket defined by the first and second spiral wraps, for example.

In some configurations of the compressor of any one or more of the above paragraphs, the second end plate includes a first passage and a second passage, wherein the first passage is open to a discharge passage and is in fluid communication with the valve assembly, and wherein the second passage is open to the axial biasing chamber and is in fluid communication with the valve assembly.

In some configurations of the compressor of any one or more of the above paragraphs, the valve assembly provides fluid communication between the first passage and the second passage when the valve assembly is in the second position.

In some configurations of the compressor of any one or more of the above paragraphs, the valve assembly provides fluid communication between the second passage and the suction-pressure region when the valve assembly is in the first position.

In some configurations of the compressor of any one or more of the above paragraphs, the valve assembly includes a valve member movable between the first position and the second position. The valve member includes a first aperture and a second aperture. When the valve member is in the first position, communication between the first passage and the first aperture is blocked and the second aperture is in communication with the suction-pressure region. When the valve member is in the second position, communication between the suction-pressure region and the second aperture is blocked and the first aperture is in communication with the first passage.

In some configurations of the compressor of any one or more of the above paragraphs, the valve assembly is a MEMS microvalve.

In some configurations of the compressor of any one or more of the above paragraphs, the compressor may include a control module controlling operation of the valve assembly. The control module may pulse-width-modulate the valve assembly between the first and second positions to achieve a desired fluid pressure within the axial biasing chamber. The desired fluid pressure may be determined based on compressor operating conditions (e.g., suction and discharge pressures or temperatures) and/or operating conditions (e.g., condensing and evaporating temperatures or pressures) of a climate-control system in which the compressor is installed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
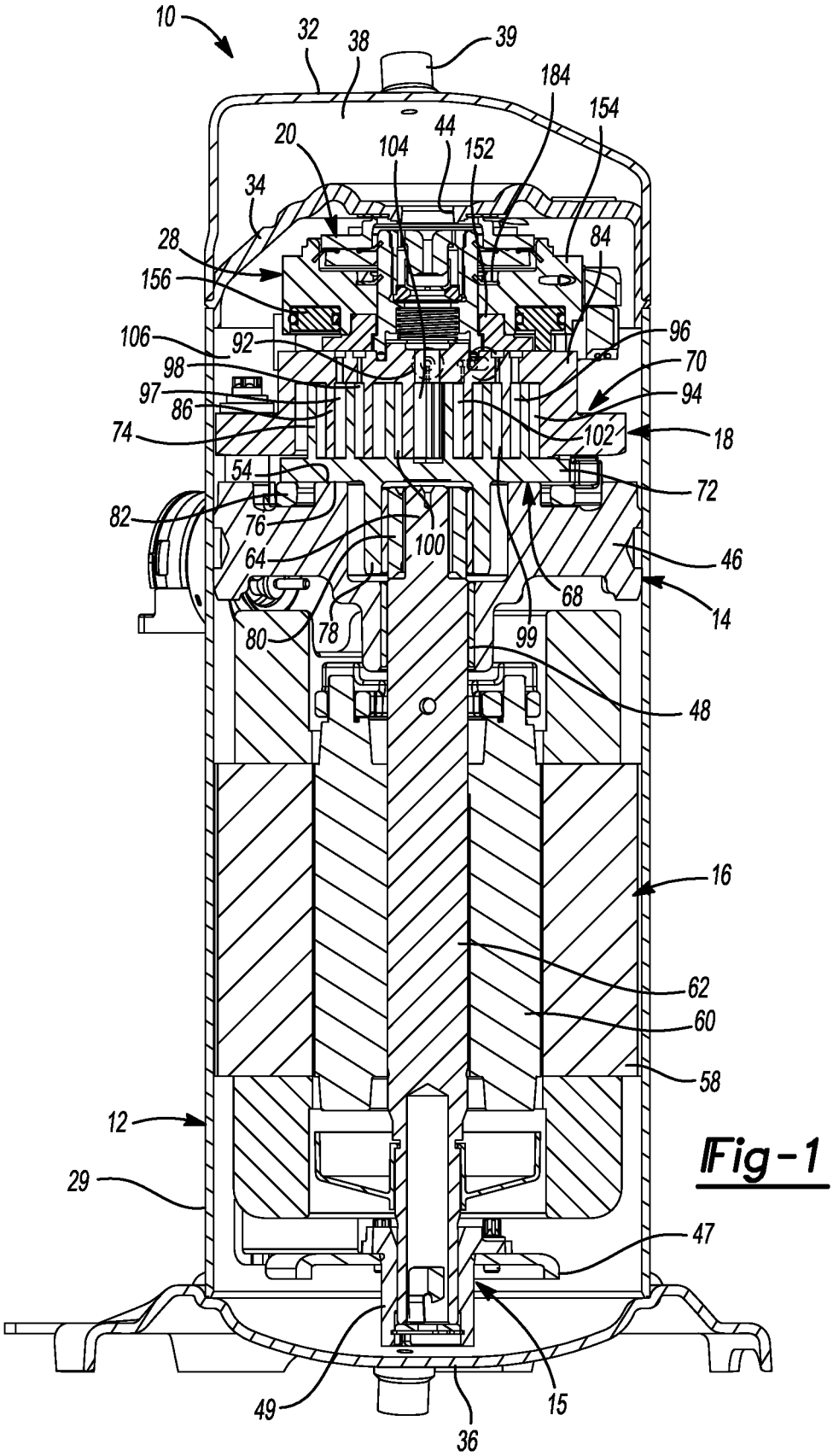
FIG. 1 is a cross-sectional view of a compressor having a capacity modulation assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a first bearing housing assembly 14, a second bearing housing assembly 15, a motor assembly 16, a compression mechanism 18, a floating seal assembly 20, and a capacity modulation assembly 28. The shell assembly 12 may house the bearing housing assemblies 14, 15, the motor assembly 16, the compression mechanism 18, the seal assembly 20, and the capacity modulation assembly 28.

The shell assembly 12 forms a compressor housing and may include a cylindrical shell 29, an end cap 32 at the upper end thereof, a transversely extending partition 34, and a base 36 at a lower end thereof. The end cap 32 and partition 34 may generally define a discharge chamber 38. The discharge chamber 38 may generally form a discharge muffler for compressor 10. While the compressor 10 is illustrated as including the discharge chamber 38, the present disclosure applies equally to direct discharge configurations. A discharge fitting 39 may be attached to the shell assembly 12 at an opening in the end cap 32. A suction gas inlet fitting (not shown) may be attached to the shell assembly 12 at another opening. The partition 34 may include a discharge passage 44 therethrough providing communication between the compression mechanism 18 and the discharge chamber 38.

The first bearing housing assembly 14 may be affixed to the shell 29 and may include a main bearing housing 46 and a first bearing 48 disposed therein. The main bearing housing 46 may house the bearing 48 therein and may define an annular flat thrust bearing surface 54 on an axial end surface thereof. The second bearing housing assembly 15 may be affixed to the shell 29 and may include a lower bearing housing 47 and a second bearing 49 disposed therein.

The motor assembly 16 may generally include a motor stator 58, a rotor 60, and a driveshaft 62. The motor stator 58 may be press fit into the shell 29. The driveshaft 62 may be rotatably driven by the rotor 60 and may be rotatably supported within the bearing 48. The rotor 60 may be press fit on the driveshaft 62. The driveshaft 62 may include an eccentric crankpin 64.

The compression mechanism 18 may include a first scroll (e.g., an orbiting scroll 68) and a second scroll (e.g., a non-orbiting scroll 70). The orbiting scroll 68 may include an end plate 72 having a spiral wrap 74 on the upper surface thereof and an annular flat thrust surface 76 on the lower surface. The thrust surface 76 may interface with the annular flat thrust bearing surface 54 on the main bearing housing 46. A cylindrical hub 78 may project downwardly from the thrust surface 76 and may have a drive bushing 80 rotatably disposed therein. The drive bushing 80 may include an inner bore in which the crank pin 64 is drivingly disposed. A flat surface of the crankpin 64 may drivingly engage a flat surface in a portion of the inner bore of the drive bushing 80 to provide a radially compliant driving arrangement. An Oldham coupling 82 may be engaged with the orbiting and non-orbiting scrolls 68, 70 or the orbiting scroll 68 and the main bearing housing 46 to prevent relative rotation therebetween.

The non-orbiting scroll 70 may include an end plate 84 defining a discharge passage 92 and having a spiral wrap 86 extending from a first side thereof. The non-orbiting scroll 70 may be attached to the bearing housing 46 via fasteners and sleeve guides that allow for a limited amount of axial movement of the non-orbiting scroll 70 relative to the orbiting scroll 68 and the bearing housing 46. The spiral wraps 74, 86 may be meshingly engaged with one another and define pockets 94, 96, 97, 98, 99, 100, 102, 104. It is understood that the pockets 94, 96, 98, 100, 102, 104 change throughout compressor operation.

A first pocket (pocket 94 in FIG. 1) may define a suction pocket in communication with a suction-pressure region (suction chamber) 106 of the compressor 10 operating at a suction pressure. A second pocket (pocket 104 in FIG. 1) may define a discharge pocket in communication with a discharge pressure region (e.g., discharge chamber 38) of the compressor 10 operating at a discharge pressure via the discharge passage 92. Pockets intermediate the first and second pockets (pockets 96, 97, 98, 99, 100, 102 in FIG. 1) may form intermediate compression pockets operating at intermediate pressures between the suction pressure and the discharge pressure.

Figure 2:
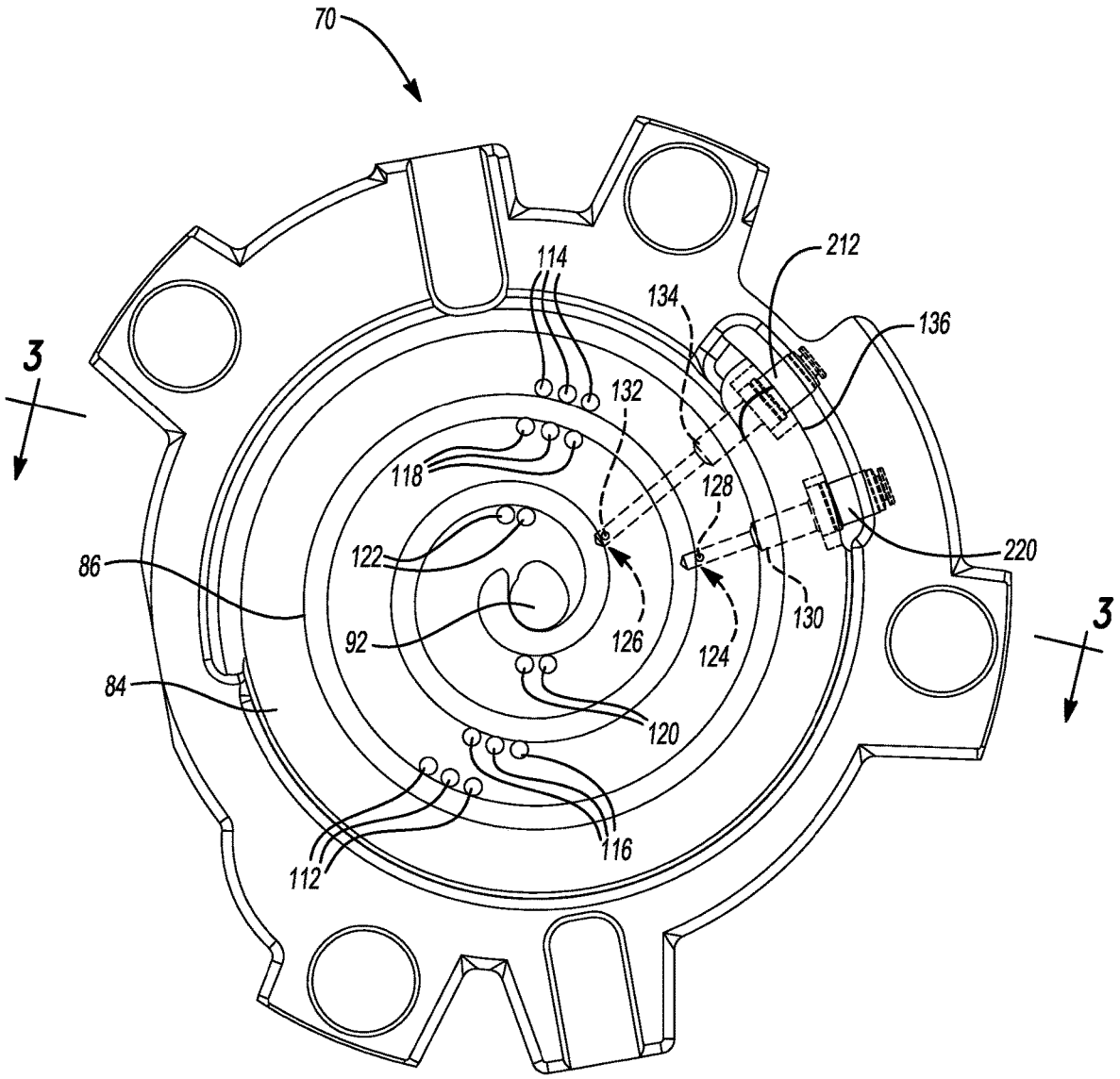
FIG. 2 is a bottom view of a non-orbiting scroll of the compressor of FIG. 1.
Figure 4:
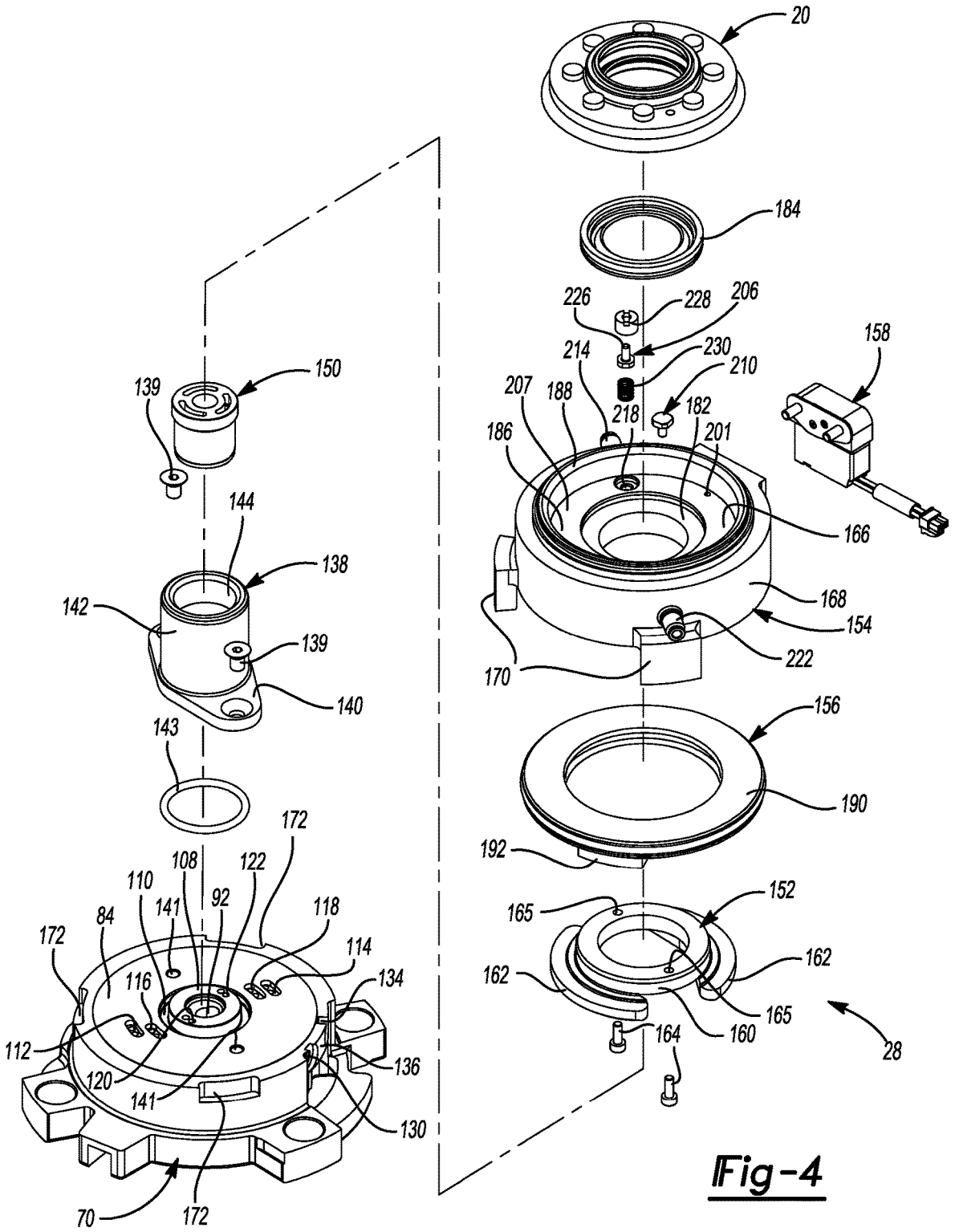
FIG. 4 is an exploded view of the non-orbiting scroll and capacity modulation assembly.
Figure 6:
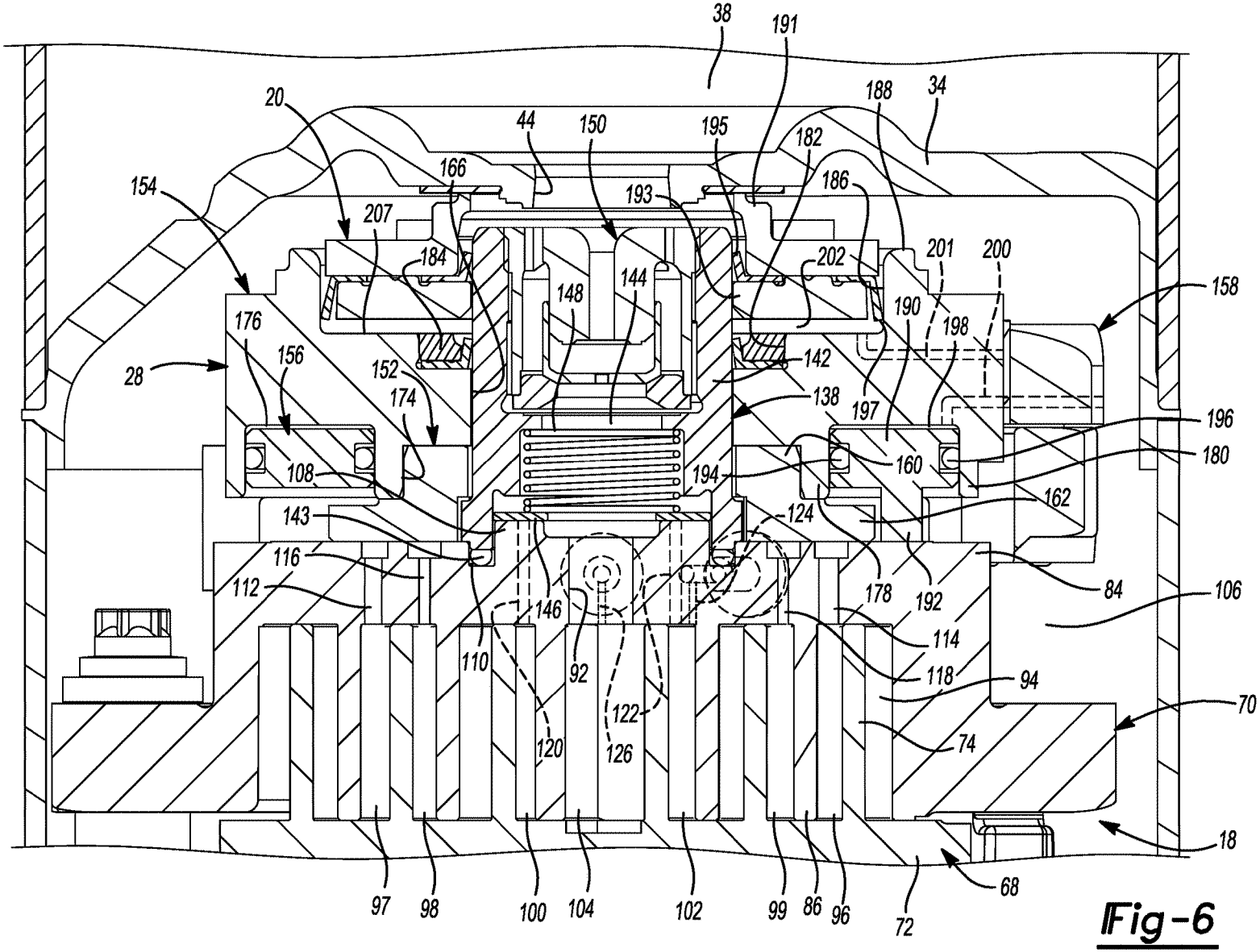
FIG. 6 is a cross-sectional view of a portion of the compressor in a full-capacity mode.

As shown in FIG. 4, the end plate 84 of the non-orbiting scroll 70 may include a raised central boss 108 and an annular groove 110 encircling the central boss 108. The discharge passage 92 may extend through the central boss 108. As shown in FIGS. 2, 4 and 6, the end plate 84 may also include a plurality of modulation passages or ports (e.g., one or more first modulation ports 112, one or more second modulation ports 114, one or more third modulation ports 116, and one or more fourth modulation ports 118), one or more first variable-volume-ratio (VVR) passages or ports 120, one or more second VVR passages or ports 122, an outer intermediate-cavity-pressure (ICP) passage or port 124, and an inner ICP passage or port 126. As shown in FIG. 6, the modulation ports 112, 114, 116, 118 may extend entirely through first and second opposing axially facing sides of the end plate 84 and are in selective fluid communication with respective intermediate pressure pockets (e.g., pockets 96, 97, 98, 99). The first and second modulation ports 112, 114 may be disposed radially outward relative to the third and fourth modulation ports 116, 118. The first and second VVR ports 120, 122 may be disposed radially inward relative to the third and fourth modulation ports 116, 118. As shown in FIG. 6, the first and second VVR ports 120, 122 may extend through the end plate 84 (e.g., through the first axially facing side of the end plate 84 and through the central boss 108. As shown in FIG. 6, the first and second VVR ports 120, 122 may be in selective fluid communication with respective intermediate pressure pockets (e.g., pockets 100, 102 disposed radially between pocket 104 and pockets 96, 97, 98, 99).

Figure 3:
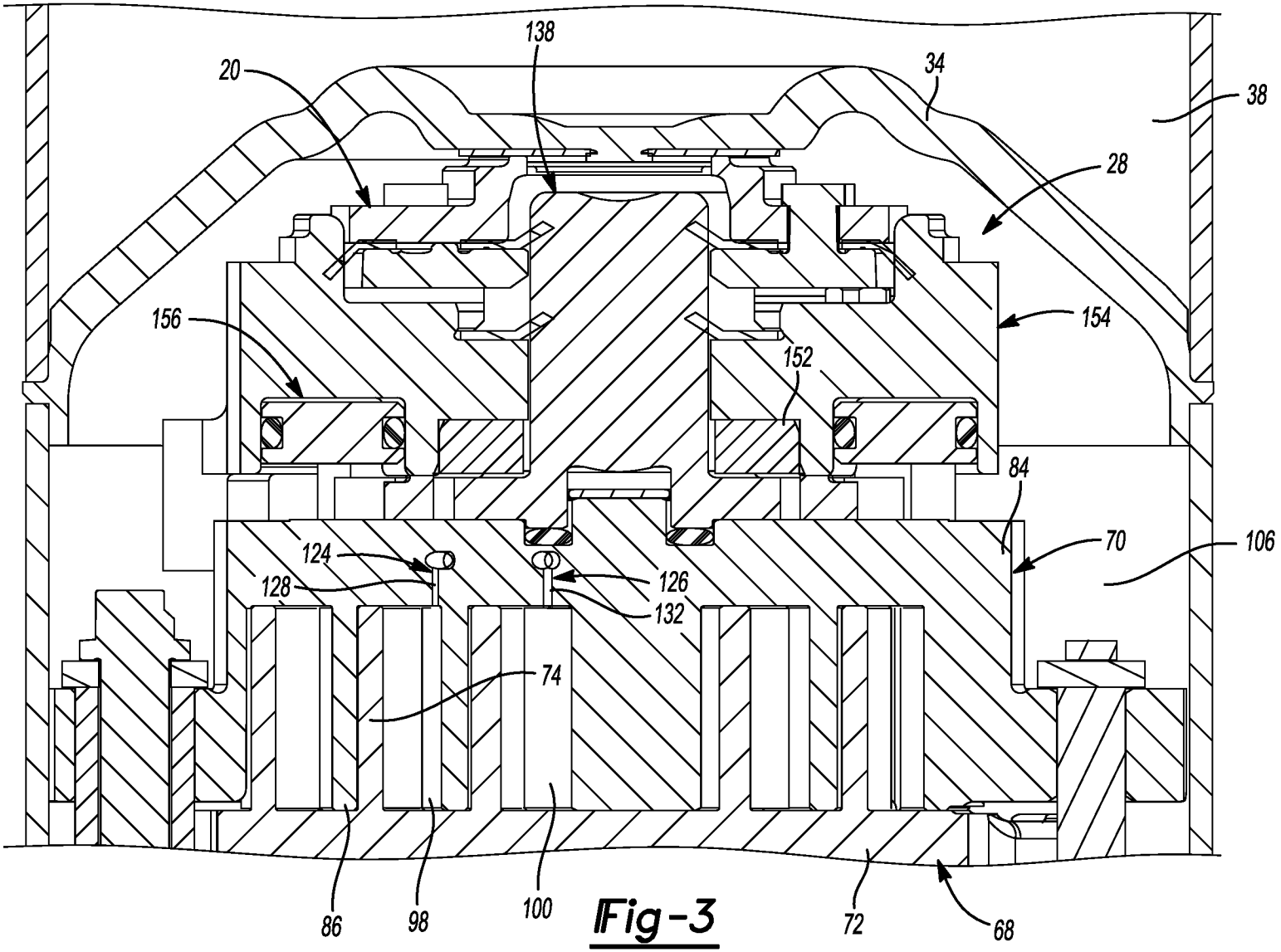
FIG. 3 is a partial cross-sectional view of the compressor taken along line 3-3 of FIG. 2.

As shown in FIG. 2, the outer ICP port 124 may include an axially extending portion 128 and a radially extending portion 130, and the inner ICP port 126 may include an axially extending portion 132 and a radially extending portion 134. As shown in FIG. 3, the axially extending portions 128, 132 of the ICP ports 124, 126 extend through the first axially facing side of the end plate 84 and extend only partially through the axial thickness of the end plate 84. As shown in FIG. 3, the axially extending portions 128, 132 are in selective fluid communication with respective intermediate pressure pockets (e.g., any of pockets 96, 97, 98, 99, 100, 102). The radially extending portions 130, 134 of the ICP ports 124, 126 extend radially from upper axial ends of the respective axially extending portions 128, 132 and through a radially peripheral surface 136 of the end plate 84, as shown in FIGS. 2 and 4.

As shown in FIG. 6, a hub 138 may be mounted to the second axially facing side of the end plate 84. The hub 138 may include a pair of feet or flange portions 140 (FIGS. 4 and 7) and a cylindrical body portion 142 (FIGS. 4, 6, and 7) extending axially from the flange portions 140. The hub 138 may be fixedly attached to the end plate 84 by fasteners 139 (FIG. 4) that extend through apertures in the flange portions 140 and into apertures 141 in the end plate 84. An annular seal 143 (FIGS. 4 and 6) is disposed in the annular groove 110 in the end plate 84 and sealingly engages the end plate 84 and the hub 138. A discharge passage 144 extends axially through the body portion 142 and is in fluid communication with the discharge chamber 38 via the discharge passage 44 in the partition 34. The discharge passage 144 is also in selective fluid communication with the discharge passage 92 in the end plate 84.

As shown in FIG. 6, a VVR valve 146 (e.g., an annular disk) may be disposed within the discharge passage 144 of the hub 138 and may be movable therein between a closed position and an open position. In the closed position (shown in FIG. 6), the VVR valve 146 contacts the central boss 108 of the end plate 84 to restrict or prevent fluid communication between the VVR ports 120, 122 and the discharge passages 144, 44. In the open position, the VVR valve 146 is spaced apart from the central boss 108 to allow fluid communication between the VVR ports 120, 122 and the discharge passages 144, 44. A spring 148 biases the VVR valve 146 toward the closed position. The VVR valve is moved into the open position when the pressure of fluid within the compression pockets that are in communication with the VVR ports 120, 122 is higher than the pressure of fluid in the discharge chamber 38.

As shown in FIG. 6, a discharge valve assembly 150 may also be disposed within the discharge passage 144 of the hub 138. The discharge valve assembly 150 may be a one-way valve that allows fluid flow from the discharge passage 92 and/or VVR ports 120, 122 to the discharge chamber 38 and restricts or prevents fluid flow from the discharge chamber 38 back into the compression mechanism 18.

Figure 7:
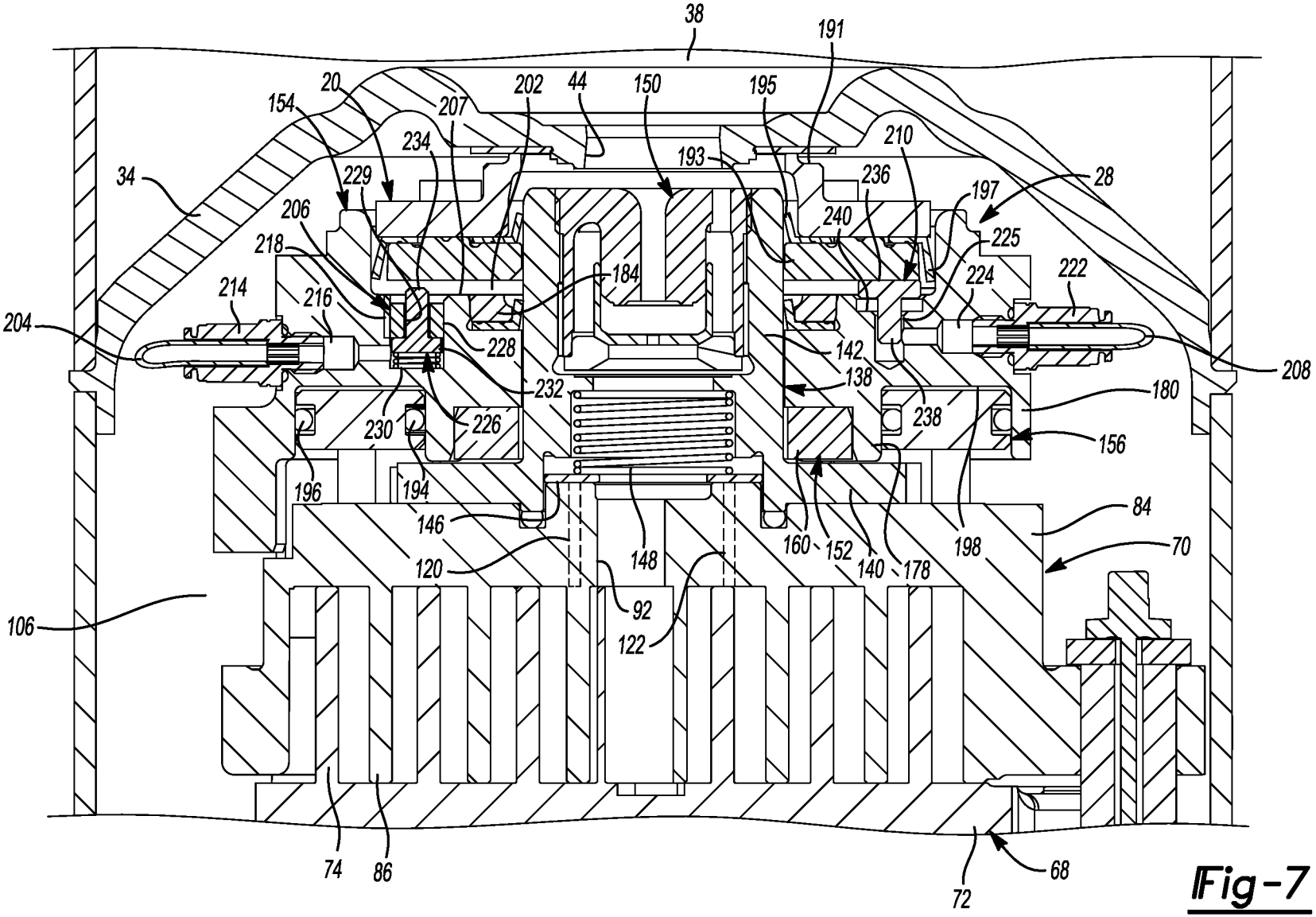
FIG. 7 is another cross-sectional view of a portion of the compressor in the full-capacity mode.
Figure 8:
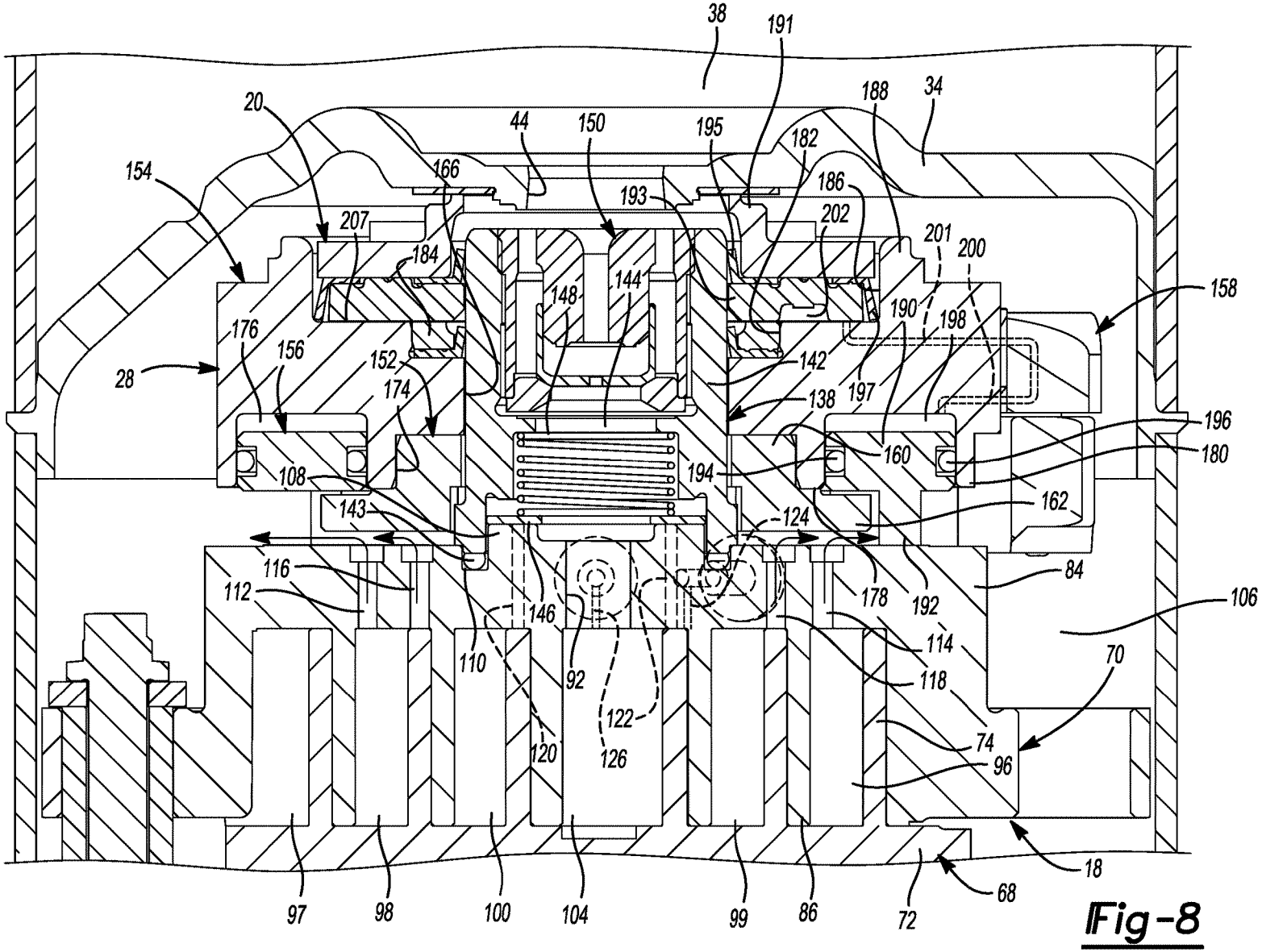
FIG. 8 is a cross-sectional view of a portion of the compressor in a reduced-capacity mode.
Figure 9:
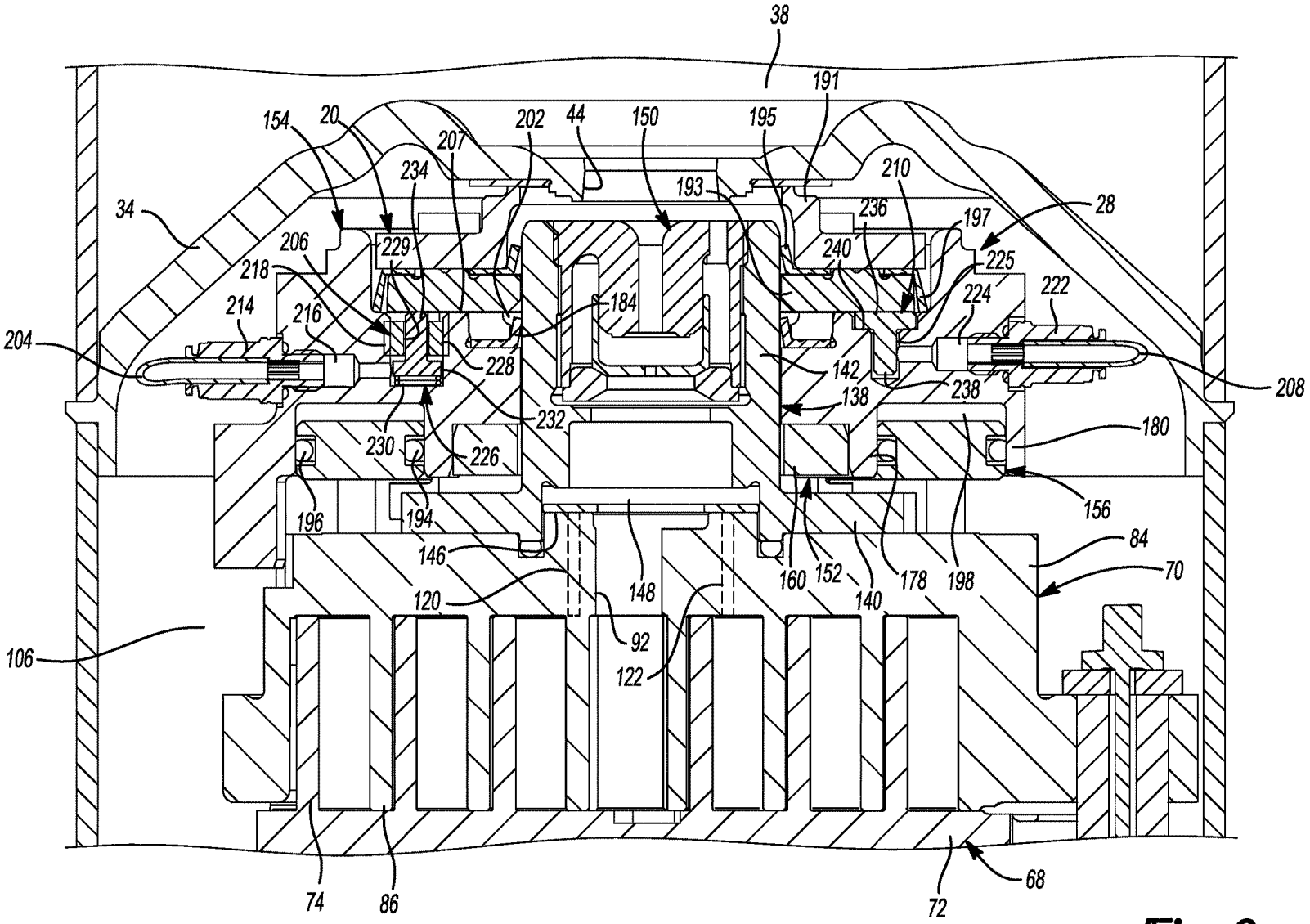
FIG. 9 is another cross-sectional view of a portion of the compressor in the reduced-capacity mode.

As shown in FIGS. 4 and 6, the capacity modulation assembly 28 may include a seal plate 152, a valve ring 154, a lift ring 156, a modulation control valve 158, a first ICP valve 206, and a second ICP valve 210. As will be described in more detail below, the capacity modulation assembly 28 is operable to switch the compressor 10 between a first capacity mode (e.g., a full-capacity mode; FIGS. 6 and 7) and a second capacity mode (e.g., a reduced-capacity mode; FIGS. 8 and 9). In the full-capacity mode, fluid communication between the modulation ports 112, 114, 116, 118 and the suction-pressure region 106 is prevented. In the reduced-capacity mode, the modulation ports 112, 114, 116, 118 are allowed to fluidly communicate with the suction-pressure region 106 to vent intermediate-pressure working fluid from intermediate compression pockets (e.g., pockets 96, 97, 98, 99) to the suction-pressure region 106.

The seal plate 152 may include an annular ring 160 having a pair of flange portions 162 that extend axially downward and radially outward from the annular ring 160. As shown in FIG. 6, the seal plate 152 may encircle the cylindrical body portion 142 of the hub 138. That is, the body portion 142 may extend through the central aperture of the ring 160 of the seal plate 152. The flange portions 140 of the hub 138 may extend underneath the annular ring 160 (e.g., between the end plate 84 and the annular ring 160) and between the flange portions 162 of the seal plate 152. The seal plate 152 may be fixedly attached to the valve ring 154 (e.g., by fasteners 164 (FIG. 4) that extend through apertures 165 in the annular ring 160 and into the valve ring 154). The seal plate 152 may be considered a part of the valve ring 154 and/or the seal plate 152 may be integrally formed with the valve ring 154.

As will be described in more detail below, the seal plate 152 is movable with the valve ring 154 in an axial direction (i.e., a direction along or parallel to a rotational axis of the driveshaft 62) relative to the end plate 84 between a first position (FIG. 6) and a second position (FIG. 8). In the first position (FIG. 6), the flange portions 162 of the seal plate 152 contact the end plate 84 and close off the modulation ports 112, 114, 116, 118 to prevent fluid communication between the modulation ports 112, 114, 116, 118 and the suction-pressure region 106. In the second position (FIG. 8), the flange portions 162 of the seal plate 152 are spaced apart from the end plate 84 to open the modulation ports 112, 114, 116, 118 to allow fluid communication between the modulation ports 112, 114, 116, 118 and the suction-pressure region 106.

As shown in FIGS. 4 and 6, the valve ring 154 may be an annular body having a stepped central opening 166 extending therethrough and through which the hub 138 extends. In other words, the valve ring 154 encircles the cylindrical body portion 142 of the hub 138. As shown in FIG. 4, the valve ring 154 may include an outer peripheral surface 168 having a plurality of key features 170 (e.g., generally rectangular blocks) that extend radially outward and axially downward from the outer peripheral surface 168. The key features 170 may be slidably received in keyways 172 (e.g., generally rectangular recesses; shown in FIG. 4) formed in the outer periphery of the end plate 84 (see FIG. 5). The key features 170 and keyways 172 allow for axial movement of the valve ring 154 relative to the non-orbiting scroll 70 while restricting or preventing rotation of the valve ring 154 relative to the non-orbiting scroll 70.

As shown in FIGS. 6-8, the central opening 166 of the valve ring 154 is defined by a plurality of steps in the valve ring 154 that form a plurality of annular recesses. For instance, a first annular recess 174 may be formed proximate a lower axial end of the valve ring 154 and may receive the ring 160 of the seal plate 152. A second annular recess 176 may encircle the first annular recess 174 and may be defined by inner and outer lower annular rims 178, 180 of the valve ring 154. The inner lower rim 178 separates the first and second annular recesses 174, 176 from each other. The lift ring 156 is partially received in the second annular recess 176. A third annular recess 182 is disposed axially above the first annular recess 174 and receives an annular seal 184 that sealingly engages the hub 138 and the valve ring 154. A fourth annular recess 186 may be disposed axially above the third annular recess 182 and may be defined by an axially upper rim 188 of the valve ring 154. The fourth annular recess 186 may receive a portion of the floating seal assembly 20.

As shown in FIGS. 4 and 6, the lift ring 156 may include an annular body 190 and a plurality of posts or protrusions 192 extending axially downward from the body 190. As shown in FIG. 6, the annular body 190 may be received within the second annular recess 176 of the valve ring 154. The annular body 190 may include inner and outer annular seals (e.g., O-rings) 194, 196. The inner annular seal 194 may sealingly engage an inner diametrical surface of the annular body 190 and the inner lower rim 178 of the valve ring 154. The outer annular seal 196 may sealingly engage an outer diametrical surface of the annular body 190 and the outer lower rim 180 of the valve ring 154. The protrusions 192 may contact the end plate 84 and axially separate the annular body 190 from the end plate 84. The lift ring 156 remains stationary relative to the end plate 84 while the valve ring 154 and the seal plate 152 move axially relative to the end plate 84.

As shown in FIGS. 6 and 8, the annular body 190 of the lift ring 156 may cooperate with the valve ring 154 to define a modulation control chamber 198. That is, the modulation control chamber 198 is defined by and disposed axially between opposing axially facing surfaces of the annular body 190 and the valve ring 154. The valve ring 154 includes a first control passage 200 that extends from the modulation control chamber 198 to the modulation control valve 158 and fluidly communicates with the modulation control chamber 198 and the modulation control valve 158.

As shown in FIGS. 6-9, the floating seal assembly 20 may be an annular member encircling the hub 138. For example, the floating seal assembly 20 may include first and second disks 191, 193 that are fixed to each other and annular lip seals 195, 197 that extend from the disks 191, 193. The floating seal assembly 20 may be sealingly engaged with the partition 34, the hub 138, and the valve ring 154. In this manner, the floating seal assembly 20 fluidly separates the suction-pressure region 106 from the discharge chamber 38. In some configurations, the floating seal assembly 20 could be a one-piece floating seal.

During steady-state operation of the compressor 10, the floating seal assembly 20 may be a stationary component. The floating seal assembly 20 is partially received in the fourth annular recess 186 of the valve ring 154 and cooperates with the hub 138, the annular seal 184 and the valve ring 154 to define an axial biasing chamber 202 (FIGS. 6-9). The axial biasing chamber 202 is axially between and defined by the floating seal assembly 20 and an axially facing surface 207 of the valve ring 154. The valve ring 154 includes a second control passage 201 that extends from the axial biasing chamber 202 to the modulation control valve 158 and fluidly communicates with the axial biasing chamber 202 and the modulation control valve 158.

The axial biasing chamber 202 is in selective fluid communication with one of the outer and inner ICP ports 124, 126 (FIGS. 2 and 3). That is, the inner ICP port 126 is in selective fluid communication with the axial biasing chamber 202 during the reduced-capacity mode via a first tube 204 (FIGS. 5 and 9), and the first ICP valve 206 (FIG. 9); and the outer ICP port 124 is in selective fluid communication with the axial biasing chamber 202 during the full-capacity mode via a second tube 208 (FIGS. 5 and 7) and the second ICP valve 210 (FIG. 7). Intermediate-pressure working fluid in the axial biasing chamber 202 (supplied by one of the ICP ports 124, 126) biases the non-orbiting scroll 70 in an axial direction (a direction along or parallel to the rotational axis of the driveshaft 62) toward the orbiting scroll 68 to provide proper axial sealing between the scrolls 68, 70 (i.e., sealing between tips of the spiral wrap 74 of the orbiting scroll 68 against the end plate 84 of the non-orbiting scroll 70 and sealing between tips of the spiral wrap 86 of the non-orbiting scroll 70 against the end plate 72 of the orbiting scroll 68).

Figure 5:
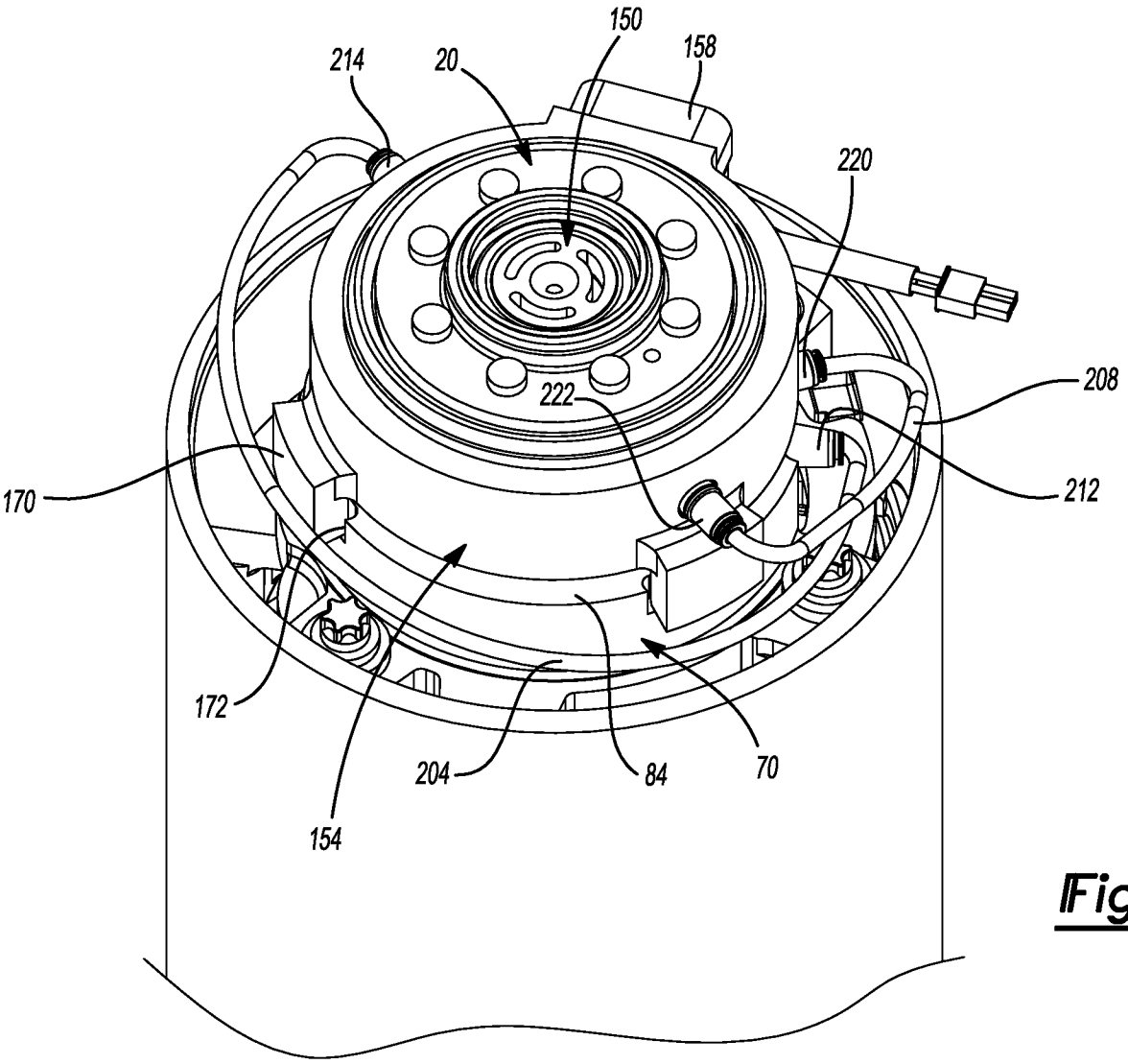
FIG. 5 is a perspective view of a portion of the compressor.

As shown in FIG. 2, the radially extending portion 134 of the inner ICP port 126 is fluidly coupled with a first fitting 212 that is fixedly attached to the end plate 84. As shown in FIG. 5, the first fitting 212 is fluidly coupled with the first tube 204. As shown in FIG. 5, the first tube 204 extends partially around the outer peripheries of the end plate 84 and the valve ring 154 and is fluidly coupled with a second fitting 214 that is fixedly attached to the valve ring 154. The first tube 204 may be flexible and/or stretchable to allow for movement of the valve ring 154 relative to the non-orbiting scroll 70. As shown in FIG. 7, the second fitting 214 is in fluid communication with a first radially extending passage 216 in the valve ring 154. As shown in FIG. 7, the first ICP valve 206 is disposed in an aperture 218 formed in the axially facing surface 207 of the valve ring 154 (the axially facing surface 207 partially defines the axial biasing chamber 202). The aperture 218 extends from the first radially extending passage 216 to the axial biasing chamber 202. As will be described in more detail below, the first ICP valve 206 controls fluid communication between the inner ICP port 126 and the axial biasing chamber 202.

As shown in FIG. 2, the radially extending portion 130 of the outer ICP port 124 is fluidly coupled with a third fitting 220 that is fixedly attached to the end plate 84. As shown in FIG. 5, the third fitting 220 is fluidly coupled with the second tube 208. As shown in FIG. 5, the second tube 208 extends partially around the outer peripheries of the end plate 84 and the valve ring 154 and is fluidly coupled with a fourth fitting 222 that is fixedly attached to the valve ring 154. The second tube 208 may be flexible and/or stretchable to allow for movement of the valve ring 154 relative to the non-orbiting scroll 70. As shown in FIG. 7, the fourth fitting 222 is in fluid communication with a second radially extending passage 224 in the valve ring 154. As shown in FIG. 7, the second ICP valve 210 is disposed in an aperture 225 formed in the axially facing surface 207 the valve ring 154. The aperture 225 extends from the second radially extending passage 224 to the axial biasing chamber 202. As will be described in more detail below, the second ICP valve 210 controls fluid communication between the outer ICP port 124 and the axial biasing chamber 202.

In some configurations, the first ICP valve 206 could be a Schrader valve, for example. In some configurations, as shown in FIGS. 7 and 9, the first ICP valve 206 may include a valve member 226, a bushing 228, and a spring 230. The valve member 226 may include a disk portion 232 and a cylindrical stem portion 234 extending axially upward from the disk portion 232 (i.e., axially toward the floating seal assembly 20). The disk portion 232 has a larger diameter than the stem portion 234. The bushing 228 may be fixedly received in the aperture 218 in the valve ring 154 and may include a central aperture 229 through which the stem portion 234 is reciprocatingly received. The distal axial end of the stem portion 234 may protrude into the axial biasing chamber 202. The disk portion 232 may be movably disposed between the lower axial end of the bushing 228 and the spring 230. The valve member 226 is axially movable relative to the bushing 228 and the valve ring 154 between a closed position (FIG. 7) and an open position (FIG. 9). The spring 230 may contact the valve ring 154 and the disk portion 232 to bias the valve member 226 toward the closed position.

When the first ICP valve 206 is in the closed position (FIG. 7), the disk portion 232 contacts the bushing 228 and prevents fluid flow through the first ICP valve 206 to prevent fluid communication between the inner ICP port 126 and the axial biasing chamber 202. When the first ICP valve 206 is in the open position (FIG. 9), the disk portion 232 is axially separated from the bushing 228 to allow fluid flow through the first ICP valve 206 (e.g., through the central aperture 229 of the bushing 228 (e.g., between the outer diametrical surface of the stem portion 234 and the inner diametrical surface of the central aperture 229 of the bushing 228)) to allow fluid communication between the inner ICP port 126 and the axial biasing chamber 202.

The second ICP valve 210 is a valve member including disk portion 236 and a cylindrical stem portion 238 extending axially downward from the disk portion 236 (i.e., axially away from the floating seal assembly 20). The disk portion 236 has a larger diameter than the stem portion 238. The stem portion 238 may be reciprocatingly received in the aperture 225 in the valve ring 154 to allow the second ICP valve 210 to move between an open position (FIG. 7) and a closed position (FIG. 9). As will be described below, the second ICP valve 210 is in the open position when the first ICP valve 206 is in the closed position (as shown in FIG. 7), and the second ICP valve 210 is in the closed position when the first ICP valve 206 is in the open position (as shown in FIG. 9).

When the second ICP valve 210 is in the open position (FIG. 7), the disk portion 236 is spaced apart from a recessed axially-facing surface 240 of the valve ring 154 to allow fluid flow through the second ICP valve 210 (e.g., through the aperture 225 (e.g., between the outer diametrical surface of the stem portion 238 and the inner diametrical surface of the aperture 225)) to allow fluid communication between the outer ICP port 124 and the axial biasing chamber 202. When the second ICP valve 210 is in the closed position (FIG. 9), the disk portion 236 is in contact with the surface 240 of the valve ring 154 to prevent fluid flow through the second ICP valve 210 to prevent fluid communication between the outer ICP port 124 and the axial biasing chamber 202.

The modulation control valve 158 may include a solenoid-operated three-way valve and may be in fluid communication with the suction-pressure region 106 and the first and second control passages 200, 201 in the valve ring 154. During operation of the compressor 10, the modulation control valve 158 may be operable to switch the compressor 10 between a first mode (e.g., a full-capacity mode) and a second mode (e.g., a reduced-capacity mode). FIGS. 6 and 8 schematically illustrate operation of the modulation control valve 158.

When the compressor 10 is in the full-capacity mode (FIGS. 6 and 7), the modulation control valve 158 may provide fluid communication between the modulation control chamber 198 and the suction-pressure region 106 via the first control passage 200, thereby lowering the fluid pressure within the modulation control chamber 198 to suction pressure. With the fluid pressure within the modulation control chamber 198 at or near suction pressure, the relatively higher fluid pressure within the axial biasing chamber 202 (e.g., an intermediate pressure) will force the valve ring 154 and seal plate 152 axially downward relative to the end plate 84 (i.e., away from the floating seal assembly 20) such that the seal plate 152 is in contact with the end plate 84 and closes the modulation ports 112, 114, 116, 118 (i.e., to prevent fluid communication between the modulation ports 112, 114, 116, 118 and the suction-pressure region 106), as shown in FIG. 6.

When the compressor 10 is in the reduced-capacity mode (FIGS. 8 and 9), the modulation control valve 158 may provide fluid communication between the modulation control chamber 198 and the axial biasing chamber 202 via the second control passage 201, thereby raising the fluid pressure within the modulation control chamber 198 to the same or similar intermediate pressure as the axial biasing chamber 202. With the fluid pressure within the modulation control chamber 198 at the same intermediate pressure as the axial biasing chamber 202, the fluid pressure within the modulation control chamber 198 and the fluid pressure in the modulation ports 112, 114, 116, 118 will force the valve ring 154 and seal plate 152 axially upward relative to the end plate 84 (i.e., toward the floating seal assembly 20) such that the seal plate 152 is spaced apart from the end plate 84 to open the modulation ports 112, 114, 116, 118 (i.e., to allow fluid communication between the modulation ports 112, 114, 116, 118 and the suction-pressure region 106), as shown in FIG. 8.

As shown in FIG. 7, in the full-capacity mode, the floating seal assembly 20 is spaced axially apart from the axially facing surface 207 of the valve ring 154 is axially spaced sufficiently far apart from the floating seal assembly 20 to provide clearance to: (a) allow the spring 230 of the first ICP valve 206 to force the valve member 226 of the first ICP valve 206 axially upward into the closed position (thereby preventing fluid communication between the inner ICP port 126 and the axial biasing chamber 202); and (b) allow fluid pressure in the second radially extending passage 224 to force the second ICP valve 210 axially upward into the open position (i.e., a pressure differential between the outer ICP port 124 and the axial biasing chamber 202 may move the second ICP valve 210 into the open position as the valve ring 154 moves into the position shown in FIG. 7, thereby allowing working fluid from the outer ICP port 124 to flow into the axial biasing chamber 202).

As shown in FIG. 9, in the reduced-capacity mode, the valve ring 154 and seal plate 152 are moved axially upward toward the floating seal assembly 20, thereby reducing or eliminating the axial space between the floating seal assembly 20 and the axially facing surface 207 of the valve ring 154. Therefore, as the valve ring 154 and seal plate 152 are moved axially upward toward the floating seal assembly 20, the floating seal assembly 20 contacts and forces the valve member 226 of the first ICP valve 206 and the valve member of the second ICP valve 210 further into their respective apertures 218, 225 in the valve ring 154, thereby opening the first ICP valve 206 (to allow working fluid from the inner ICP port 126 to flow into the axial biasing chamber 202) and closing the second ICP valve 210 (to prevent fluid communication between the axial biasing chamber and the outer ICP port 124).

Accordingly, the axial biasing chamber 202 receives working fluid from the outer ICP port 124 when the compressor 10 is operating in the full-capacity mode, and the axial biasing chamber 202 receives working fluid from the inner ICP port 126 when the compressor 10 is operating in the reduced-capacity mode. As shown in FIG. 3, the inner ICP port 126 may be open to (i.e., in direct fluid communication with) one of the compression pockets (such as one of the intermediate-pressure pockets 98, 100, for example) that is radially inward relative to the compression pocket to which the outer ICP port 124 is open (i.e., the compression pocket with which the outer ICP port 124 is in direct fluid communication). Therefore, for any given set of operating conditions, the compression pocket to which the inner ICP port 126 is open may be at a higher pressure than the compression pocket to which the outer ICP port 124 is open.

By switching which one of the ICP ports 124, 126 supplies working fluid to the axial biasing chamber 202 when the compressor 10 is switched between the full-capacity and reduced-capacity modes, the capacity modulation assembly 28 of the present disclosure can supply working fluid of a more preferred pressure to the axial biasing chamber 202 in both the full-capacity and reduced-capacity modes. That is, while the pressure of the working fluid supplied by the outer ICP port 124 may be appropriate while the compressor is in the full-capacity mode, the pressure of the working fluid at the outer ICP port 124 is lower during the reduced-capacity mode (due to venting of working fluid to the suction-pressure region 106 through modulation ports 112, 114, 116, 118 during the reduced-capacity mode) than it is during the full-capacity mode. To compensate for that reduction in fluid pressure, the second ICP valve 210 closes and the first ICP valve 206 opens in the reduced-capacity mode so that working fluid from the inner ICP port 126 is supplied to the axial biasing chamber during the reduced-capacity mode. In this manner, working fluid of an appropriately high pressure can be supplied to the axial biasing chamber 202 during the reduced-capacity mode to adequately bias the non-orbiting scroll 70 axially toward the orbiting scroll 68 to ensure appropriate sealing between the tips of spiral wraps 74, 86 and end plates 84, 72, respectively.

Supplying working fluid to the axial biasing chamber 202 from the outer ICP port 124 (rather than from the inner ICP port 126) in the full-capacity mode ensures that the pressure of working fluid in the axial biasing chamber 202 is not too high in the full-capacity mode, which ensures that the scrolls 70, 68 are not over-clamped against each other. Over-clamping the scrolls 70, 68 against each other (i.e., biasing the non-orbiting scroll 70 axially toward the orbiting scroll 68 with too much force) would introduce an unduly high friction load between the scrolls 68, 70, which would result in increased wear, increased power consumption and efficiency losses. Therefore, the operation of the ICP valves 206, 210 described above minimizes wear and improves efficiency of the compressor 10 in the full-capacity and reduced-capacity modes.

While the capacity modulation assembly 28 is described above as an assembly that selectively allows venting of modulation ports in the end plate to the suction-pressure region, in some configurations, the capacity modulation assembly 28 could additionally or alternatively include a vapor-injection system that selectively injects working fluid into one or more intermediate-pressure compression pockets to boost the capacity of the compressor. One or more passages in one of both of the end plates 72, 84 may be provided through which the working fluid may be injected into the one or more intermediate-pressure compression pockets. One or more valves may be provided to control the flow of working fluid into the one or more intermediate-pressure compression pockets.

Figure 10:
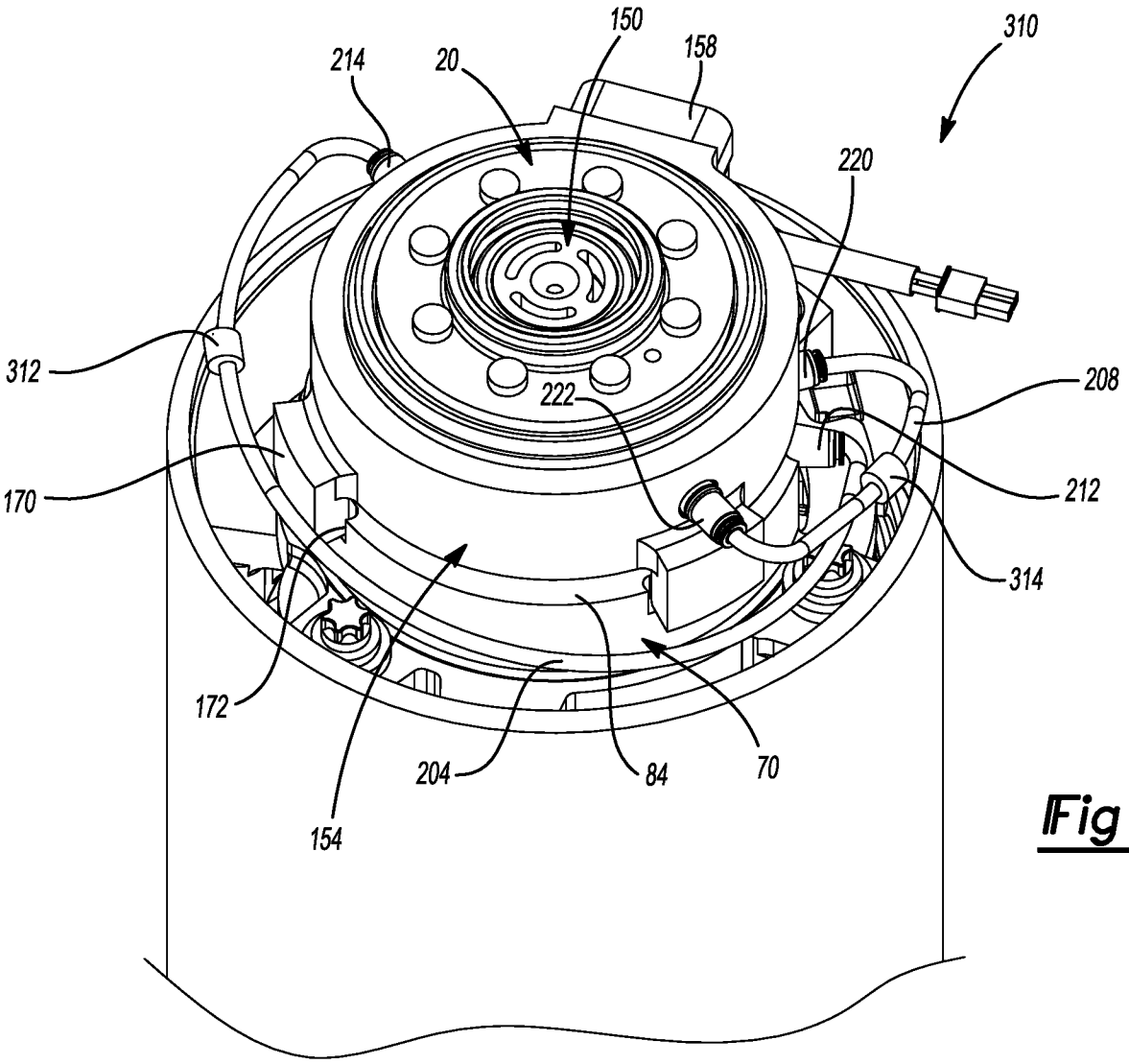
FIG. 10 is a perspective view of a portion of another compressor according to the principles of the present disclosure.

With reference to FIG. 10, a compressor 310 is provided. The structure and function of the compressor 310 may be similar or identical to that of the compressor 10 described above, apart from the differences described below. Like the compressor 10, the compressor 310 may include first and second tubes 204, 208 to provide fluid communication between the ICP ports 124, 126 and the axial biasing chamber 202. However, instead of having ICP valves 206, 210 mounted to the valve ring 154 to control fluid communication between the ICP ports 124, 126 and the axial biasing chamber 202 (as in the compressor 10), the compressor 310 may include first and second ICP valves 312, 314 disposed on the first and second tubes 204, 208, respectively. The first and second ICP valves 312, 314 may be solenoid valves, for example, and may be controlled by a controller (e.g., processing circuitry). When the compressor 310 is operating in the reduced-capacity mode, the controller may: (a) move the first ICP valve 312 to an open position to allow fluid flow from the inner ICP port 126 to the axial biasing chamber 202, and (b) move the second ICP valve 314 to a closed position to restrict or prevent fluid flow between the outer ICP port 124 and the axial biasing chamber 202. When the compressor 310 is operating in the full-capacity mode, the controller may: (a) move the second ICP valve 314 to an open position to allow fluid flow from the outer ICP port 124 to the axial biasing chamber 202, and (b) move the first ICP valve 312 to a closed position to restrict or prevent fluid flow between the inner ICP port 126 and the axial biasing chamber 202.

Figure 11:
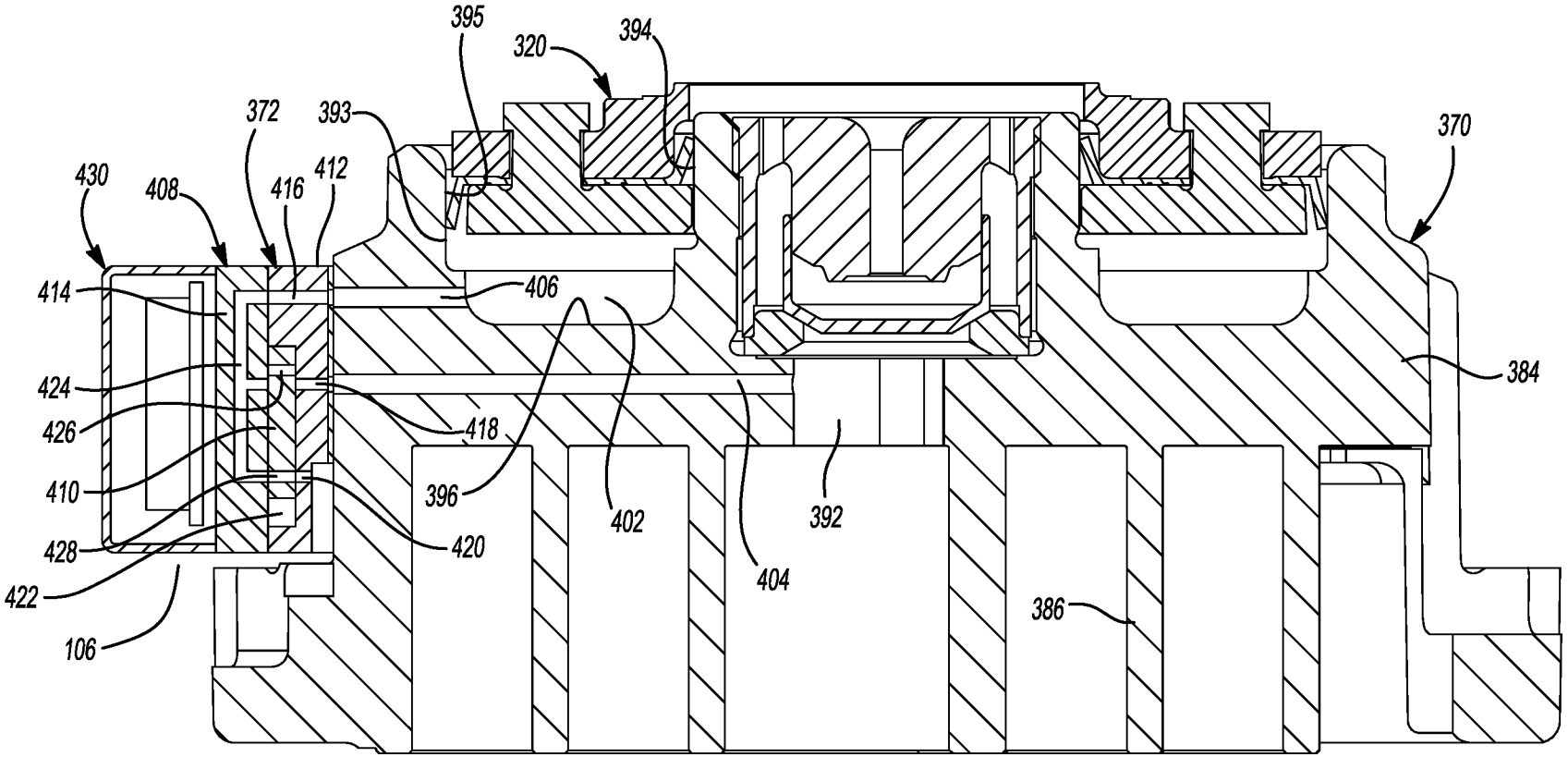
FIG. 11 is a cross-sectional view of an alternative non-orbiting scroll and a valve assembly in a first position according to the principles of the present disclosure.
Figure 12:
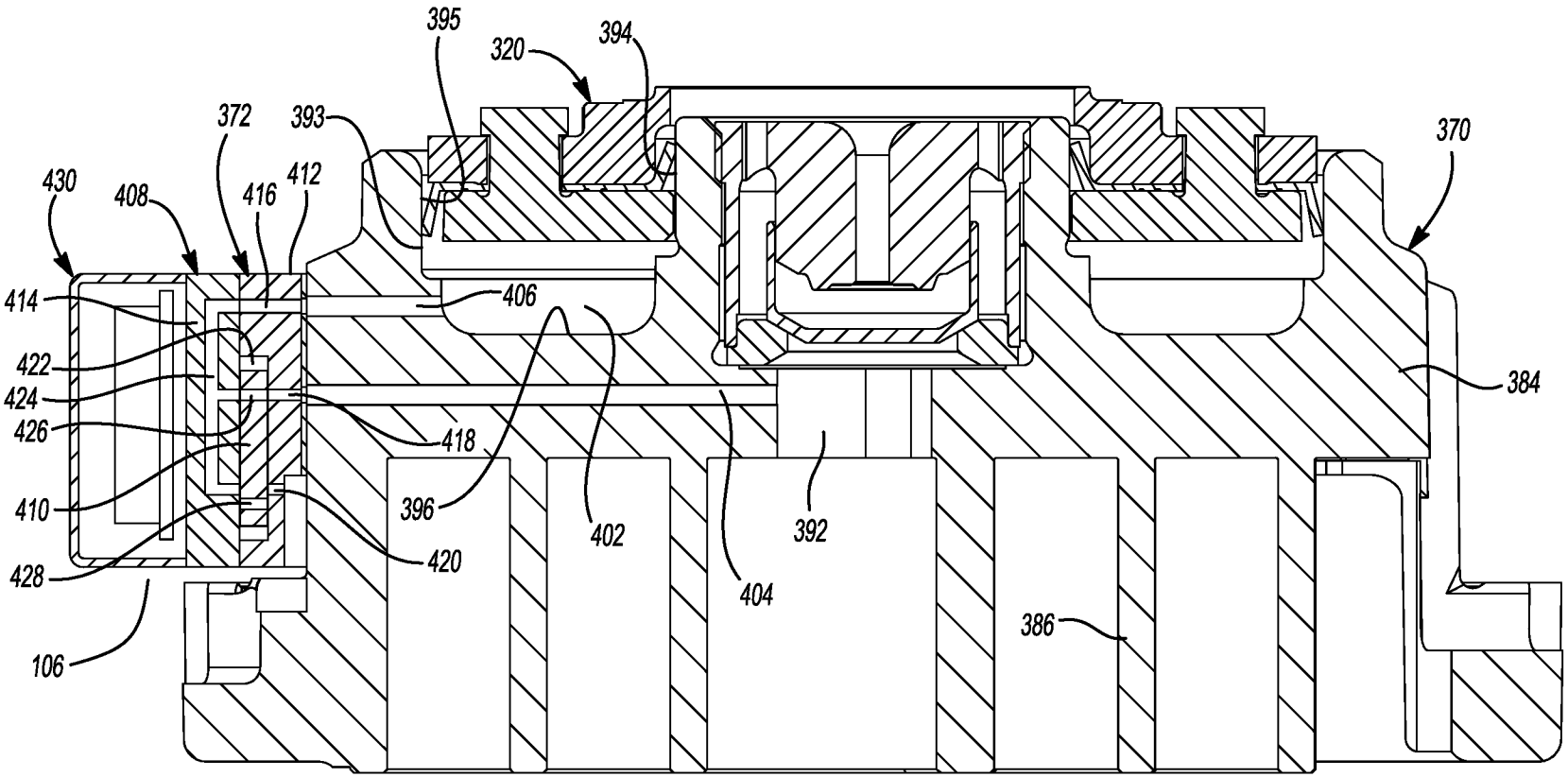
FIG. 12 is a cross-sectional view of the non-orbiting scroll and valve assembly of FIG. 11 in a second position according to the principles of the present disclosure.

With reference to FIGS. 11 and 12, an alternative non-orbiting scroll 370 and a valve assembly 372 are provided. The non-orbiting scroll 370 and valve assembly 372 could be incorporated into the compressor 10 instead of the non-orbiting scroll 70 and capacity modulation assembly 28.

The non-orbiting scroll may include an end plate 384 defining a discharge passage 392 and having a spiral wrap 386 extending from a first side thereof. The non-orbiting scroll 370 may be attached to the bearing housing 46 via fasteners and sleeve guides that allow for a limited amount of axial movement of the non-orbiting scroll 370 relative to the orbiting scroll 68 and the bearing housing 46. The spiral wrap 386 may be meshingly engaged with the spiral wrap 74 of the orbiting scroll 68 and the spiral wraps 74, 386 define pockets (e.g., similar or identical to pockets 94, 96, 97, 98, 99, 100, 102, 104 described above).

An annular recess 393 may be formed in the end plate 384 of the non-orbiting scroll 370. An annular floating seal assembly 320 (similar or identical to the floating seal 20 described above) may be received within the annular recess 393. The floating seal assembly 20 may be sealingly engaged with the partition 34 and inner and outer diametrical surfaces 394, 395 that define the recess 393. In this manner, the floating seal assembly 320 fluidly separates the suction-pressure region 106 of the compressor 10 from the discharge chamber 38 of the compressor 10. An axial biasing chamber 402 is axially between and defined by the floating seal assembly 320 and an axially facing surface 396 of the end plate 384.

The end plate 384 may include a first passage 404 and a second passage 406. In some configurations, the first and second passages 404, 406 may extend radially through a portion of the end plate 384. One end of the first passage 404 may be open to and in fluid communication with the discharge passage 392. The other end of the first passage 404 may be fluidly coupled with the valve assembly 372. One end of the second passage 406 may be open to and in fluid communication with the axial biasing chamber 402. The other end of the second passage 406 may be fluidly coupled with the valve assembly 372.

The valve assembly 372 may include a valve body 408 and a valve member 410. The valve member 410 is movable relative to the valve body 408 between a first position (FIG. 11) and a second position (FIG. 12). When the valve member 410 is in the first position, the valve assembly 372 provides fluid communication between the axial biasing chamber 402 and the suction-pressure region 106 of the compressor 10. When the valve member 410 is in the second position, the valve assembly 372 provides fluid communication between the axial biasing chamber 402 and the discharge passage 392 (i.e., a discharge-pressure region).

The valve body 408 may include a first body member 412 and a second body member 414. The first body member 412 may be mounted to the end plate 384 and may include first, second and third apertures 416, 418, 420 and a recess 422. The first aperture 416 may be fluidly connected to the second passage 406 in the end plate 384. The second aperture 418 may be fluidly connected to the first passage 404 in the end plate 384. The third aperture 420 may be open to and in fluid communication with the suction-pressure region 106. The recess 422 in the first body member 412 may movably receive the valve member 410.

The second body member 414 may include a communication passage 424. The communication passage 424 may be: (a) in constant fluid communication with the first aperture 416 of the first body member 412, (b) in selective fluid communication with second aperture 418 of the first body member 412, and (c) in selective fluid communication with the third aperture 420 of the first body member 412.

The valve member 410 is disposed within the recess 422 in the first body member 412 and is movable within the recess 422 between the first and second positions. The valve member 410 may include a first aperture 426 and a second aperture 428.

When the valve member 410 is in the first position (FIG. 11): (a) the valve member 410 blocks fluid communication between the second aperture 418 of the first body member 412 and the communication passage 424 in the second body member 414, thereby blocking fluid communication between the discharge passage 392 and the axial biasing chamber 402; and (b) the second aperture 428 in the valve member 410 provides fluid communication between the third aperture 420 of the first body member 412 and the communication passage 424 of the second body member 414, thereby providing fluid communication between the suction-pressure region 106 and the axial biasing chamber 402.

When the valve member 410 is in the second position (FIG. 12): (a) the valve member 410 blocks fluid communication between the third aperture 420 of the first body member 412 and the communication passage 424 in the second body member 414, thereby blocking fluid communication between the suction-pressure region 106 and the axial biasing chamber 402; and (b) the first aperture 426 in the valve member 410 provides fluid communication between the second aperture 418 of the first body member 412 and the communication passage 424 of the second body member 414, thereby providing fluid communication between the discharge passage 392 and the axial biasing chamber 402.

In some configurations, the valve assembly 372 may be a MEMS (micro-electro-mechanical systems) valve assembly. For example, the valve member 410 may include silicon ribs (or other resistive elements). A flow of electrical current through the silicon ribs causes the silicon ribs to expand (due to thermal expansion), which results in linear displacement of the valve member 410.

The valve assembly 372 may include a control module 430 having processing circuitry for controlling movement of the valve member 410 between the first and second positions. The valve assembly 372 may be in communication with pressure sensors (or the valve assembly 372 may have built-in pressure sensing capability) to detect pressures of working fluid within the suction-pressure region 106, the axial biasing chamber 402, and the discharge passage 392. The control module 430 may control movement of the valve member 410 based on the values of such pressures (and/or based on additional or alternative operating parameters) to maintain optimum pressures within the axial biasing chamber 402 to provide optimum the force biasing non-orbiting scroll 370 toward the orbiting scroll 68 at various operating conditions in the operating envelope of the compressor 10. The valve assembly 372 may also function as a high-pressure cutout device or pressure-relief valve to vent the axial biasing chamber 402 to the suction-pressure region 106 if pressure within the axial biasing chamber 402 raises above a predetermined threshold.

At initial startup of the compressor 10, the control module 430 may position the valve member 410 at the second position (FIG. 12) so that discharge-pressure working fluid is communicated to the axial biasing chamber 402 to provide sufficient initial axial loading of the non-orbiting scroll 370 against the orbiting scroll 68.

During operation of the compressor 10, the control module 430 may receive signals from sensors measuring suction and discharge pressures (or pressures within the suction-pressure region 106 and discharge passage 392) and reference a lookup table stored in the memory of the control module 430 to determine a desired or ideal pressure value for the axial biasing chamber 402 for a given set of suction and discharge pressures. The control module 430 could pulse the valve member 410 between the first and second positions to achieve the ideal pressure value. After achieving the desired pressure in the axial biasing chamber 402, the control module 430 may move the valve member 410 to a third position (e.g., downward relative to the second position shown in FIG. 12) in which both of the apertures 426, 428 in the valve member 410 are blocked from fluid communication with both of the apertures 418, 420 in the valve body 408 to prevent fluid communication between the axial biasing chamber 402 and the suction-pressure region 106 and between the axial biasing chamber 402 and the discharge passage 392. Thereafter, the control module 430 could move or pulse (e.g., pulse-width-modulate) the valve member 410 among any of the first, second and third positions, as appropriate.

In some configurations, during shutdown of the compressor 10, the control module 430 may position the valve member 410 in the first position (FIG. 11) so that suction-pressure working fluid is communicated to the axial biasing chamber 402 to allow the floating seal assembly 320 to drop down further into the recess 393 and allow discharge gas in the discharge chamber 38 to flow into the suction-pressure region 106 to prevent reverse rotation of the orbiting scroll 68.

While the valve body 408 is described above as having the first and second body members 412, 414, in some configurations, the valve body 408 could be a one-piece valve body. Furthermore, while the valve assembly 372 is described above as a MEMS valve assembly, in some configurations, the valve assembly 372 could be any other type of valve assembly, such as a solenoid, piezoelectric, or stepper valve, for example (i.e., the valve member 410 could be actuated by a solenoid, piezoelectric, or stepper actuator).

Figure 13:
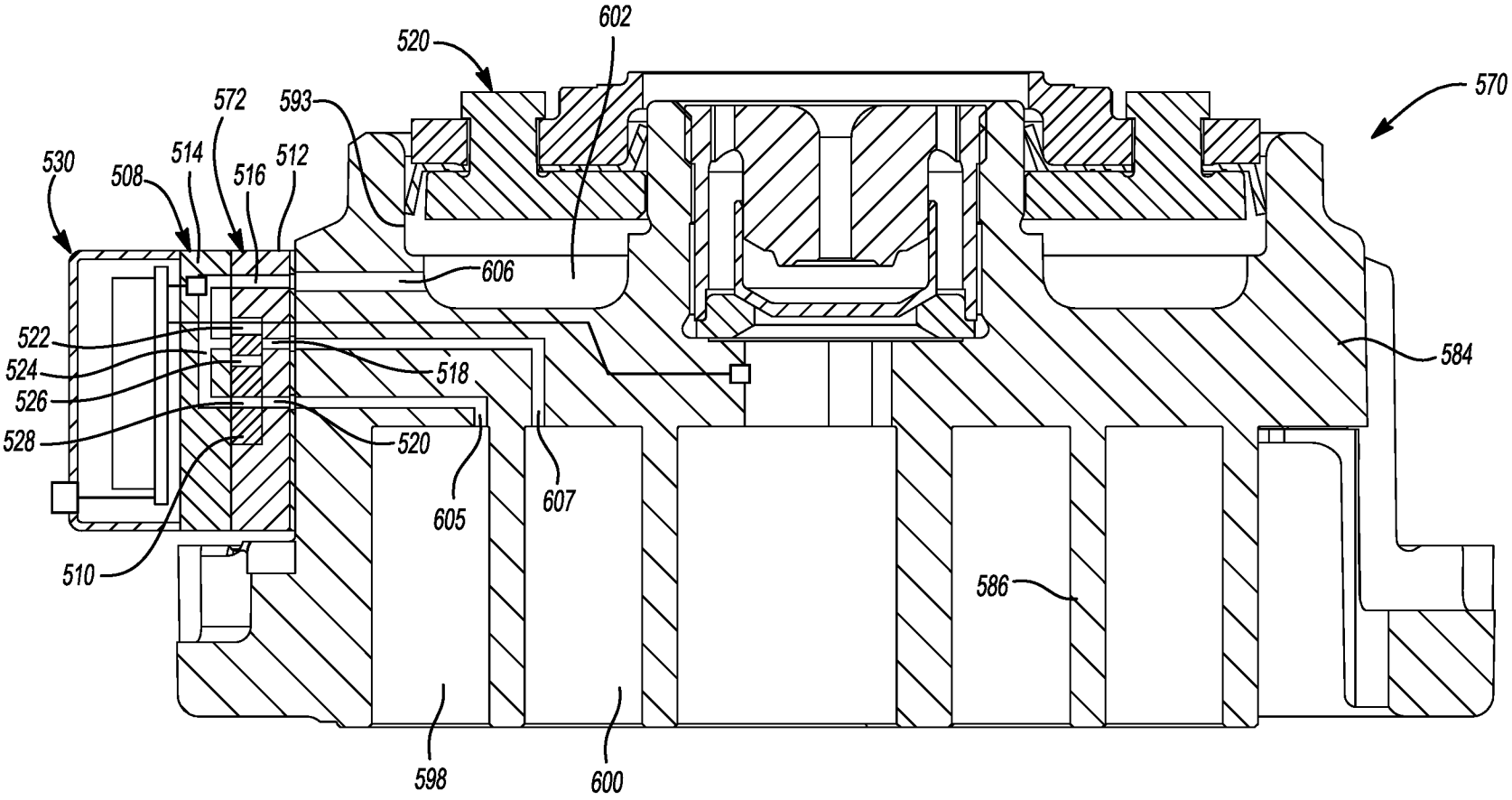
FIG. 13 is a cross-sectional view of another alternative non-orbiting scroll and an alternative valve assembly in a first position according to the principles of the present disclosure.
Figure 14:
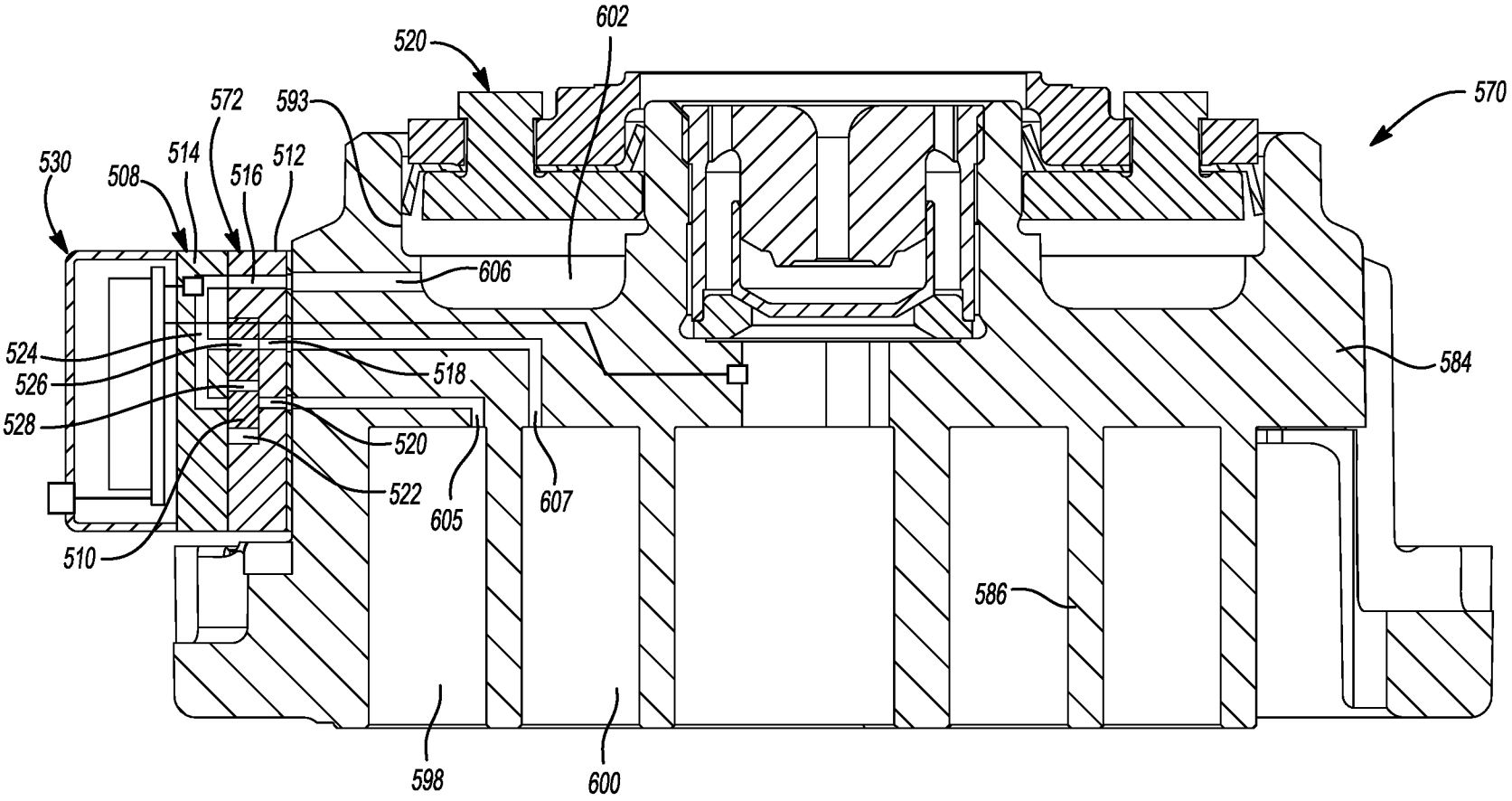
FIG. 14 is a cross-sectional view of the non-orbiting scroll and valve assembly of FIG. 13 in a second position according to the principles of the present disclosure.

With reference to FIGS. 13 and 14, another alternative non-orbiting scroll 570 and valve assembly 572 are provided. The non-orbiting scroll 570 and valve assembly 572 could be incorporated into the compressor 10 instead of the non-orbiting scroll 70 and capacity modulation assembly 28 and instead of the non-orbiting scroll 370 and valve assembly 372.

The structure and function of the non-orbiting scroll 570 and valve assembly 572 may be similar or identical to that of the non-orbiting scroll 370 and valve assembly 372, apart from exceptions noted below. Therefore, at least some similar features will not be described again in detail.

Like the non-orbiting scroll 370, the non-orbiting scroll 570 may include an end plate 584, a spiral wrap 586, and a recess 593 in the end plate 584 in which a floating seal assembly 520 is received to define an axial biasing chamber 602. The floating seal assembly 520 may be similar or identical to the floating seal assembly 20, 320. The end plate 584 may include a passage 606 (like the passage 406) that is open to and in fluid communication with the axial basing chamber 604 at one end and fluidly connected to the valve assembly 572 at the other end.

Instead of the first passage 404, the end plate 584 may include may include an outer ICP passage or port 605 and an inner ICP passage or port 607. One end of the outer port 605 may be open to and in fluid communication with a first intermediate-pressure compression pocket 598 (e.g. like pocket 98 described above) and the other end of the outer port 605 may be fluidly connected to the valve assembly 572. One end of the inner port 607 may be open to and in fluid communication with a second intermediate-pressure compression pocket 600 (e.g. like pocket 100 described above) that is disposed radially inward relative to the first intermediate-pressure pocket 598 and is at an intermediate pressure that is higher than the pressure of pocket 598. The other end of the inner port 607 may be fluidly connected to the valve assembly 572.

The valve assembly 572 may include a valve body 508 and a valve member 510. The valve member 510 is movable relative to the valve body 508 between a first position (FIG. 13) and a second position (FIG. 14). When the valve member 510 is in the first position, the valve assembly 572 provides fluid communication between the axial biasing chamber 502 and the first intermediate-pressure pocket 598. When the valve member 510 is in the second position, the valve assembly 572 provides fluid communication between the axial biasing chamber 502 and the second intermediate-pressure pocket 600.

The valve body 508 may include a first body member 512 and a second body member 514. The first body member 512 may be mounted to the end plate 584 and may include first, second and third apertures 516, 518, 520 and a recess 522. The first aperture 516 may be fluidly connected to the passage 606 in the end plate 584. The second aperture 518 may be fluidly connected to the inner port 607 in the end plate 584. The third aperture 520 may be open to and in fluid communication with the outer port 605 in the end plate 584. The recess 522 in the first body member 512 may movably receive the valve member 510.

The second body member 514 may include a communication passage 524. The communication passage 524 may be: (a) in constant fluid communication with the first aperture 516 of the first body member 512, (b) in selective fluid communication with second aperture 518 of the first body member 512, and (c) in selective fluid communication with the third aperture 520 of the first body member 512.

The valve member 510 is disposed within the recess 522 in the first body member 512 and is movable within the recess 522 between the first and second positions. The valve member 510 may include a first aperture 526 and a second aperture 528.

When the valve member 510 is in the first position (FIG. 13): (a) the valve member 510 blocks fluid communication between the second aperture 518 of the first body member 512 and the communication passage 524 in the second body member 514, thereby blocking fluid communication between the second intermediate-pressure pocket 600 and the axial biasing chamber 602; and (b) the second aperture 528 in the valve member 510 provides fluid communication between the third aperture 520 of the first body member 512 and the communication passage 524 of the second body member 514, thereby providing fluid communication between the first intermediate-pressure pocket 598 and the axial biasing chamber 402.

When the valve member 510 is in the second position (FIG. 14): (a) the valve member 510 blocks fluid communication between the third aperture 520 of the first body member 512 and the communication passage 524 in the second body member 514, thereby blocking fluid communication between the first intermediate-pressure pocket 598 and the axial biasing chamber 502; and (b) the first aperture 526 in the valve member 510 provides fluid communication between the second aperture 518 of the first body member 512 and the communication passage 524 of the second body member 514, thereby providing fluid communication between the second intermediate-pressure pocket 600 and the axial biasing chamber 602.

In some configurations, the valve assembly 572 may be a MEMS (micro-electro-mechanical systems) valve assembly and may include a control module 530 having processing circuitry for controlling movement of the valve member 510 between the first and second positions. The control module 530 may control the valve member 510 in the same or a similar manner as described above with respect to the control module 430 and valve member 410. In some configurations, the valve assembly 572 could be any other type of valve assembly, such as a solenoid, piezoelectric, or stepper valve, for example (i.e., the valve member 510 could be actuated by a solenoid, piezoelectric, or stepper actuator).

With reference to FIGS. 15-23, another alternative non-orbiting scroll 770, valve assembly 772, and capacity modulation system 728 are provided. The non-orbiting scroll 770, valve assembly 772 and capacity modulation system 728 could be incorporated into the compressor 10 instead of the non-orbiting scroll 70, 310, ICP valves 206, 210, 312, 314, modulation control valve 158, and capacity modulation assembly 28 and instead of the non-orbiting scroll 370 and valve assembly 372. That is, the valve assembly 772 can replace the ICP valves 206, 210, 312, 314 and the modulation control valve 158.

The structure and function of the non-orbiting scroll 770 and capacity modulation system 728 may be similar to that of the non-orbiting scroll 70 and capacity modulation system 28. Therefore, at least some similar features will not be described again in detail.

The non-orbiting scroll 770 may include an end plate 784 and a spiral wrap 786. The spiral wrap 786 may be meshingly engaged with the spiral wrap 74 of the orbiting scroll 68 and the spiral wraps 74, 786 define pockets (e.g., similar or identical to pockets 94, 96, 97, 98, 99, 100, 102, 104 described above).

The end plate 784 may include one or more modulation passages or ports 812, 814. The modulation ports 812, 814 may be open to and in fluid communication with respective intermediate-pressure pockets 96-102. The end plate 784 may also include an outer ICP passage or port 824, and an inner ICP passage or port 826 (shown schematically in FIGS. 15 and 16). The inner port 826 is disposed radially inward relative to the outer port 824 and is in fluid communication with a second one of the intermediate-pressure pockets (e.g., like 96-102).

One end of the outer port 824 may be open to and in fluid communication with a first intermediate-pressure compression pocket 798 (e.g. like pocket 98) and the other end of the outer port 824 may be fluidly connected to the valve assembly 772. One end of the inner port 826 may be open to and in fluid communication with a second intermediate-pressure compression pocket 800 (e.g. like pocket 100 described above) that is disposed radially inward relative to the first intermediate-pressure pocket 798 and is at an intermediate pressure that is higher than the pressure of pocket 798. The other end of the inner port 826 may be fluidly connected to the valve assembly 772.

The capacity modulation assembly 728 may include a valve ring 854 (e.g., similar to the valve ring 154) and a lift ring 856 (e.g., similar or identical to the lift ring 156). The valve ring 854 may encircle and sealingly engage a central annular hub 788 of the end plate 784. The lift ring 856 may be received within an annular recess 876 formed in the valve ring 854 and may include a plurality of posts or protrusions (not shown; e.g., like protrusions 192) that contact the end plate 384.

The lift ring 856 may cooperate with the valve ring 854 to define a modulation control chamber 898 (e.g., like modulation control chamber 198). That is, the modulation control chamber 898 is defined by and disposed axially between opposing axially facing surfaces of the lift ring 856 and the valve ring 854. A first control passage 900 (shown schematically in FIGS. 15 and 16) may extend through a portion of the valve ring 854, for example, and may extend from the modulation control chamber 898 to the valve assembly 772. The first control passage 900 fluidly communicates with the modulation control chamber 898 and the valve assembly 772.

An annular floating seal 820 (similar or identical to the floating seal 120, 320) may be disposed radially between the hub 788 of the end plate 784 and an annular rim 855 of the valve ring 854. The floating seal 820 may sealingly engage the hub 788 and the rim 855. The floating seal 820, the end plate 784, and the valve ring 854 cooperate to form an axial biasing chamber 902.

A second control passage 904 (shown schematically in FIGS. 15 and 16) may extend through a portion of the valve ring 854, for example, and may extend from the axial biasing chamber 902 to the valve assembly 772. The second control passage 904 fluidly communicates with the biasing chamber 902 and the valve assembly 772.

Figure 15:
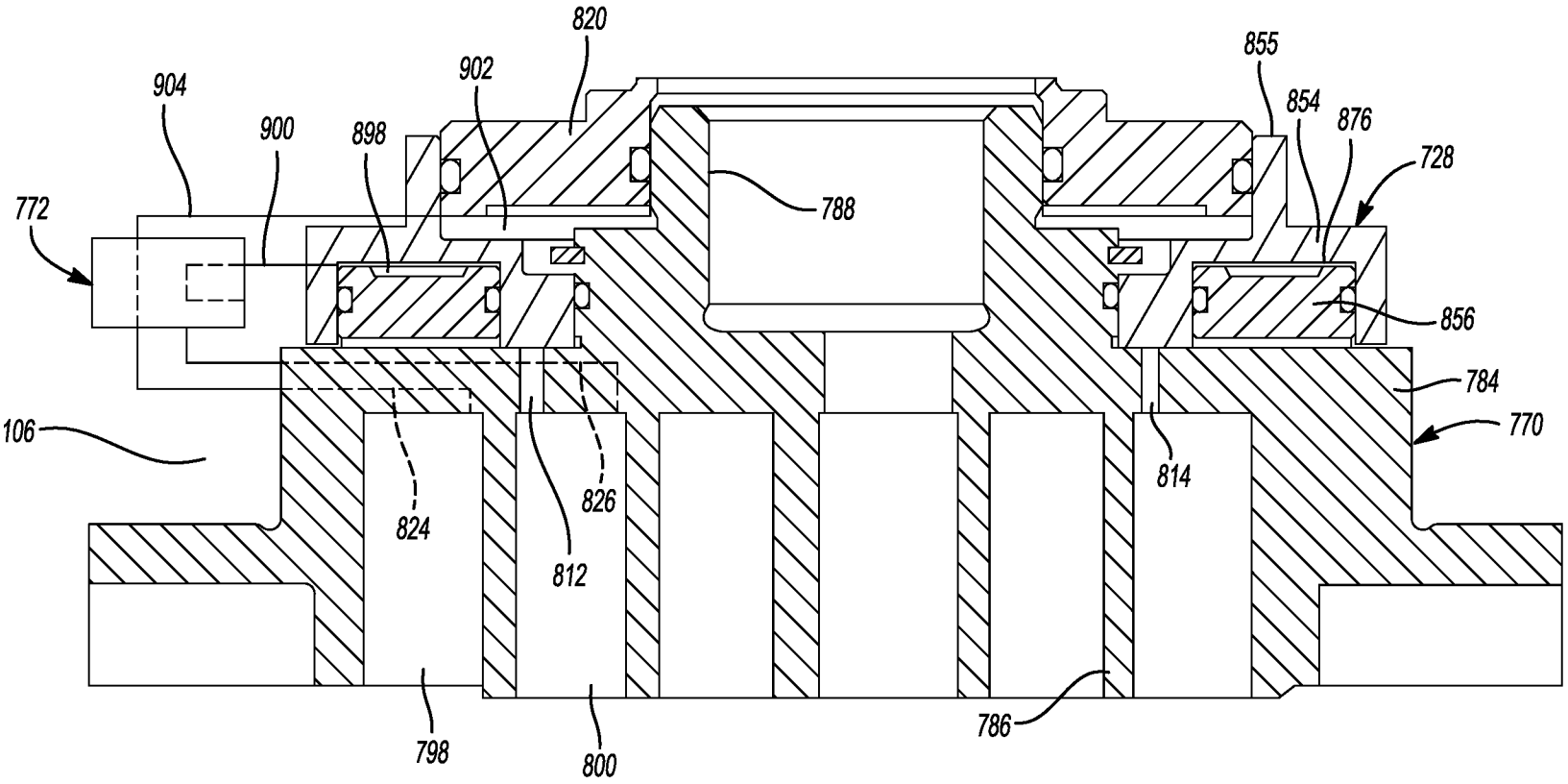
FIG. 15 is a cross-sectional view of yet another alternative non-orbiting scroll, an alternative valve assembly, and an alternative capacity modulation assembly in a first position according to the principles of the present disclosure.
Figure 16:
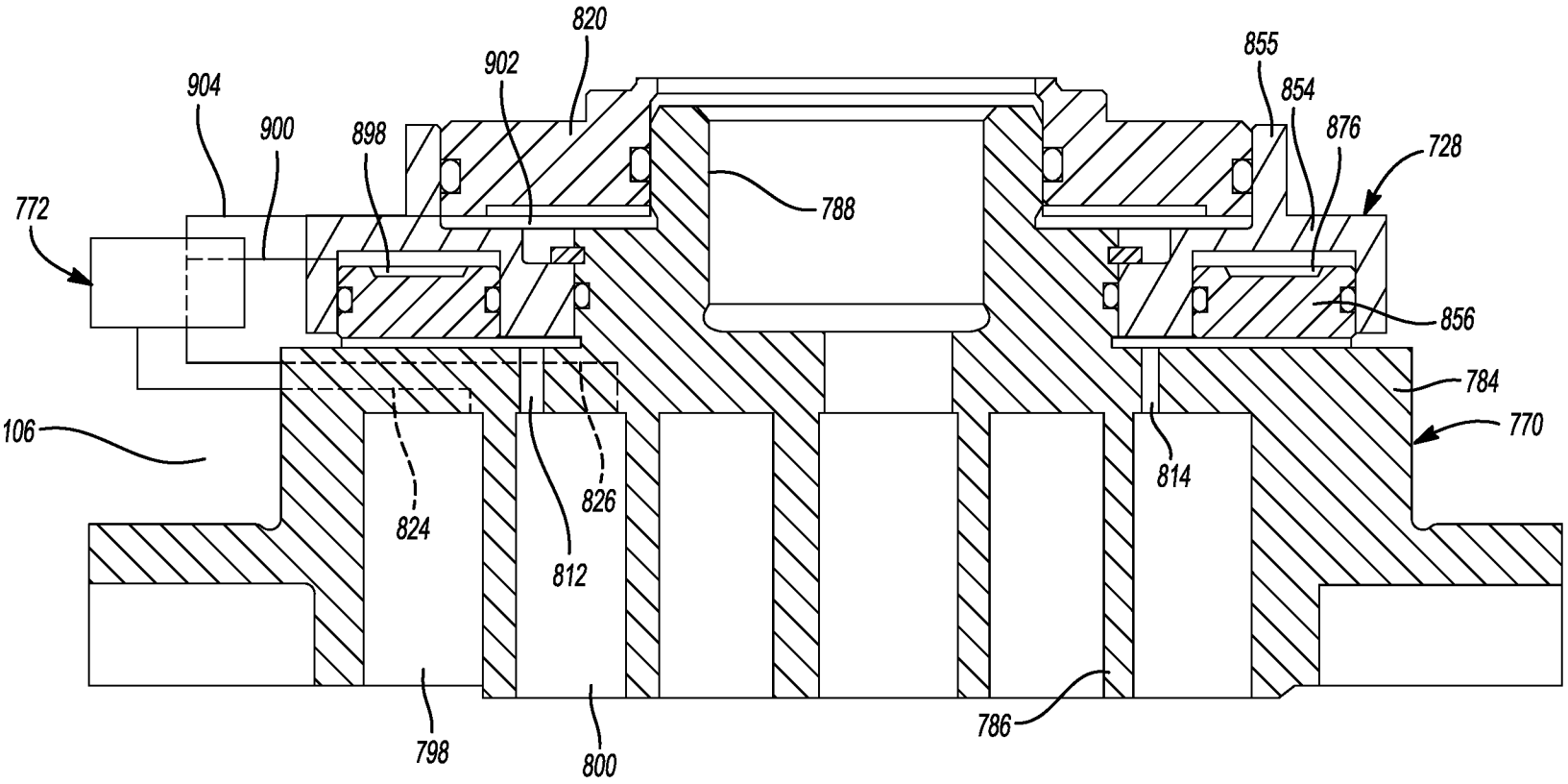
FIG. 16 is a cross-sectional view of the non-orbiting scroll, valve assembly and capacity modulation assembly of FIG. 15 in a second position according to the principles of the present disclosure.

The valve ring 854 may be movable relative to the end plate 784 between a first position (FIG. 15) and a second position (FIG. 16). In the first position, the valve ring 854 axially abuts the end plate 784 and blocks fluid communication between the modulation ports 812, 814 and the suction-pressure region 106 of the compressor 10. The valve ring 854 is axially movable relative to the end plate 784 and floating seal 820 from the first position to the second position such that, in the second position (FIG. 16), the modulation ports 812, 814 are allowed to fluidly communicate with the suction-pressure region 106.

As shown in FIGS. 17-23, the valve assembly 772 may include a valve body 910 and a valve member 912 that is movable relative to the valve body 910 between a first position (FIGS. 15 and 18-20) and a second position (FIGS. 16 and 21-23). As shown in FIG. 15, when the valve member 912 is in the first position, the valve member 912: (a) provides fluid communication between the outer port 824 and the axial biasing chamber 902, (b) blocks fluid communication between the inner port 826 and the axial biasing chamber 902, (c) provides fluid communication between the modulation control chamber 898 and the suction-pressure region 106, and (d) blocks fluid communication between the axial biasing chamber 902 and the modulation control chamber 898. As shown in FIG. 16, when the valve member 912 is in the second position, the valve member 912: (a) allows fluid communication between the axial biasing chamber 902, the modulation control chamber 898, and the inner port 826, (b) blocks fluid communication between the outer port 824 and the axial biasing chamber 902, and (c) blocks fluid communication between the modulation control chamber 898 and the suction-pressure region 106. Moving the valve member 912 to the first position (FIGS. 18-20) moves the valve ring 854 to the first position (FIG. 15), which allows the compressor 10 to operate at full capacity. Moving the valve member 912 to the second position (FIGS. 21-23) moves the valve ring 854 to the second position (FIG. 16), which allows the compressor 10 to operate at a reduced capacity.

Figure 17:
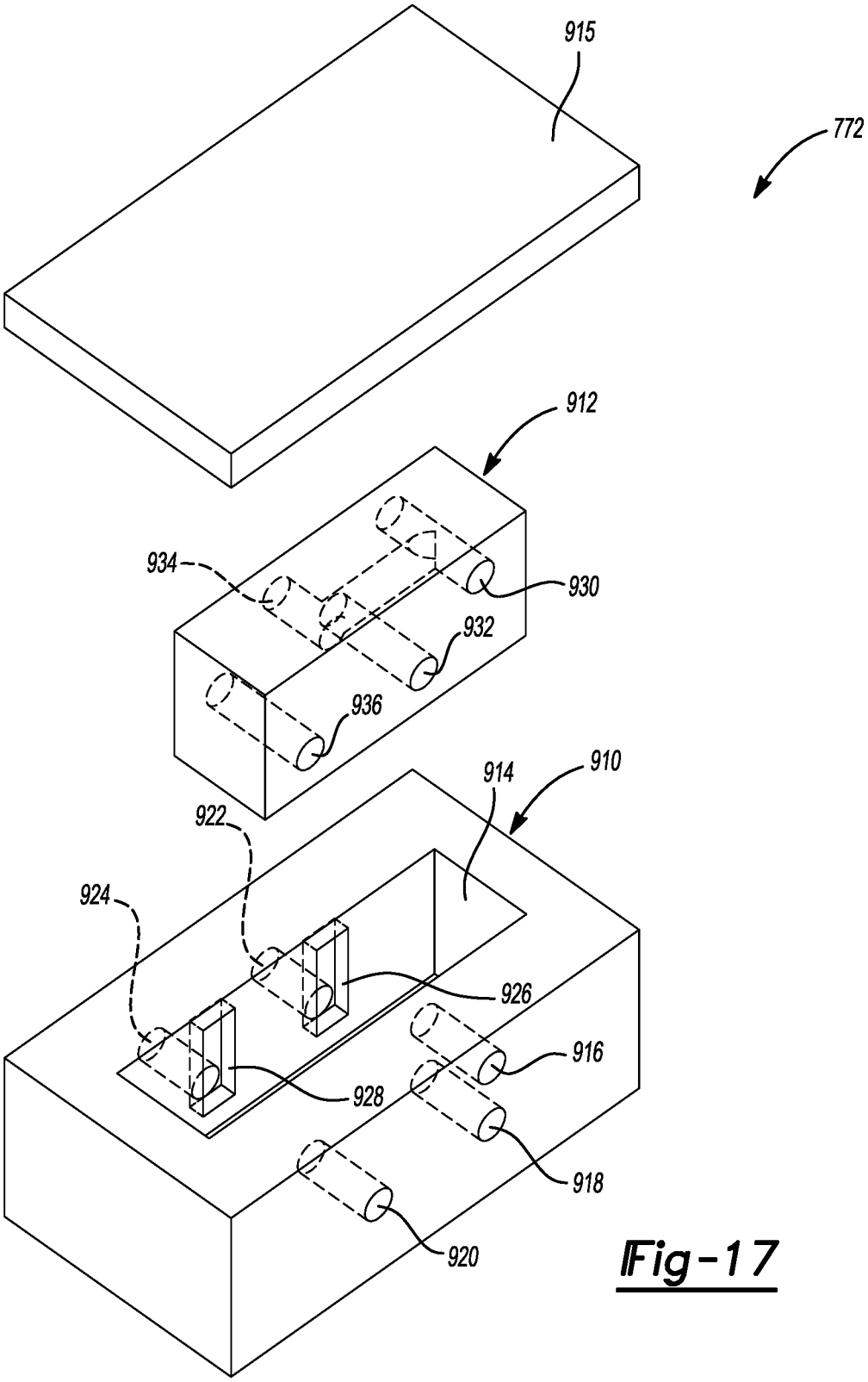
FIG. 17 is an exploded view of the valve assembly of FIGS. 15 and 16.

As shown in FIG. 17, the valve body 910 may include a cavity 914 in which the valve member 912 is movably disposed. A lid or cap 915 may enclose the valve member 912 within the cavity 914. The valve body 910 may include a first opening 916, a second opening 918, a third opening 920, a fourth opening 922, and a fifth opening 924. The openings 916, 918, 920, 922, 924 extend through walls of the valve body 910 to the cavity 914. First and second recesses 926, 928 may be formed in an interior wall of the valve body 910 (e.g., an interior wall defining the cavity 914). The first recess 926 is open to and in communication with the fourth opening 922. The second recess 928 is open to and in communication with the fifth opening 924.

The first opening 916 in the valve body 910 may be fluidly connected (either directly or via a conduit or connector) to the inner port 826 in the end plate 784. The second opening 918 in the valve body 910 may be fluidly connected (either directly or via a conduit or connector) to the outer port 824 in the end plate 784. The third opening 920 in the valve body 910 may be open to in in fluid communication with the suction-pressure region 106 of the compressor 10. The fourth opening 922 in the valve body 910 may be fluidly connected (e.g., via a conduit or connector) to the axial biasing chamber 902. The fifth opening 924 in the valve body 910 may be fluidly connected (e.g., via a conduit or connector) to the modulation control chamber 898.

As shown in FIGS. 17-23, the valve member 912 may include a first aperture 930, a second aperture 932, a third aperture 934, and a fourth aperture 936. A fifth aperture 938 (FIGS. 18 and 21) may fluidly connect the first aperture 930 with the third aperture 934.

Figure 18:
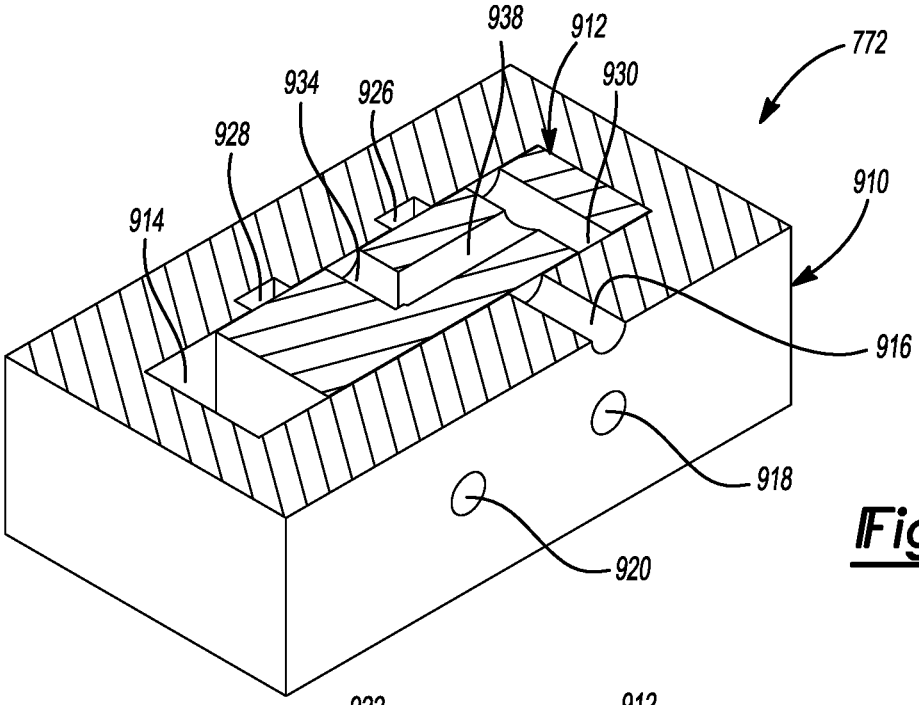
FIG. 18 is a cross-sectional view of the valve assembly of FIG. 17 in the first position.
Figure 19:
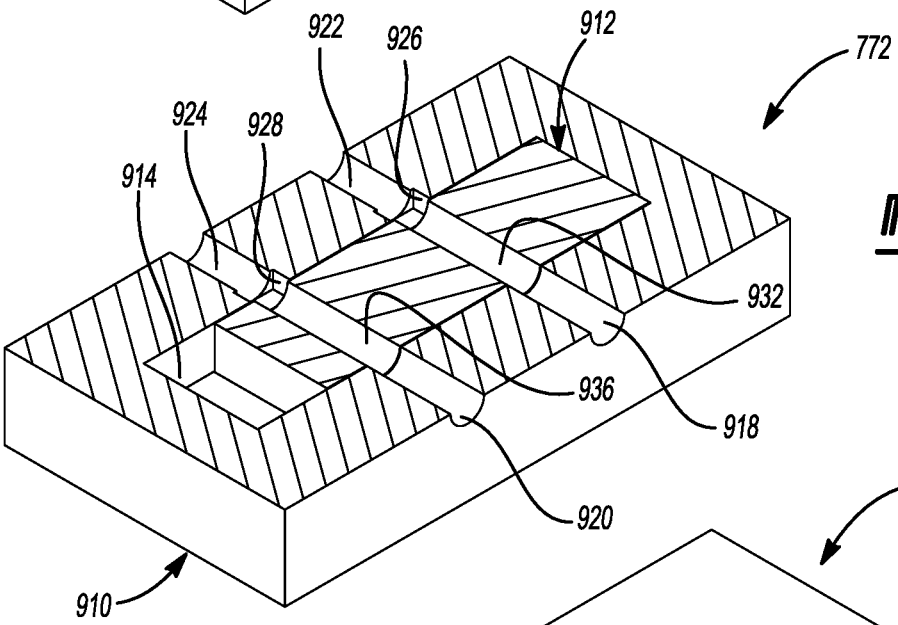
FIG. 19 is another cross-sectional view of the valve assembly of FIG. 17 in the first position.
Figure 20:
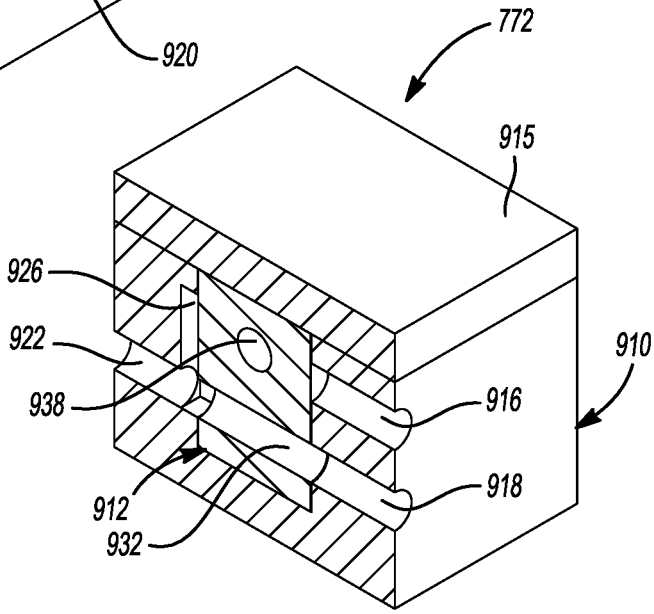
FIG. 20 is yet another cross-sectional view of the valve assembly of FIG. 17 in the first position.

As shown in FIGS. 18-20, when the valve member 912 is in the first position: (a) the first aperture 930 in the valve member 912 is blocked from fluid communication with the first opening 916 in the valve body 910, and the first and third apertures 930, 934 in the valve member 912 are blocked from fluid communication with the first and second recesses 926, 928 and the fourth and fifth openings 922, 924 in the valve body 910 (as shown in FIG. 18), thereby blocking fluid communication among the inner port 826, the axial biasing chamber 902 and the modulation control chamber 898; (b) the second aperture 932 in the valve member 912 is in fluid communication with the second and fourth openings 918, 922 in the valve body 910 (as shown in FIG. 19), thereby providing fluid communication between the outer port 824 and the axial biasing chamber 902; (c) the fourth aperture 936 in the valve member 912 is in fluid communication with the third and fifth openings 920, 924 in the valve body 910, thereby providing fluid communication between the modulation control chamber 898 and the suction-pressure region 106. By venting the modulation control chamber 898 to the suction-pressure region 106, intermediate-pressure fluid in the axial biasing chamber 902 forces the valve ring 854 axially against the end plate 784, to close off fluid communication between the modulation ports 812, 814 and the suction-pressure region 106 (as shown in FIG. 15).

Figure 21:
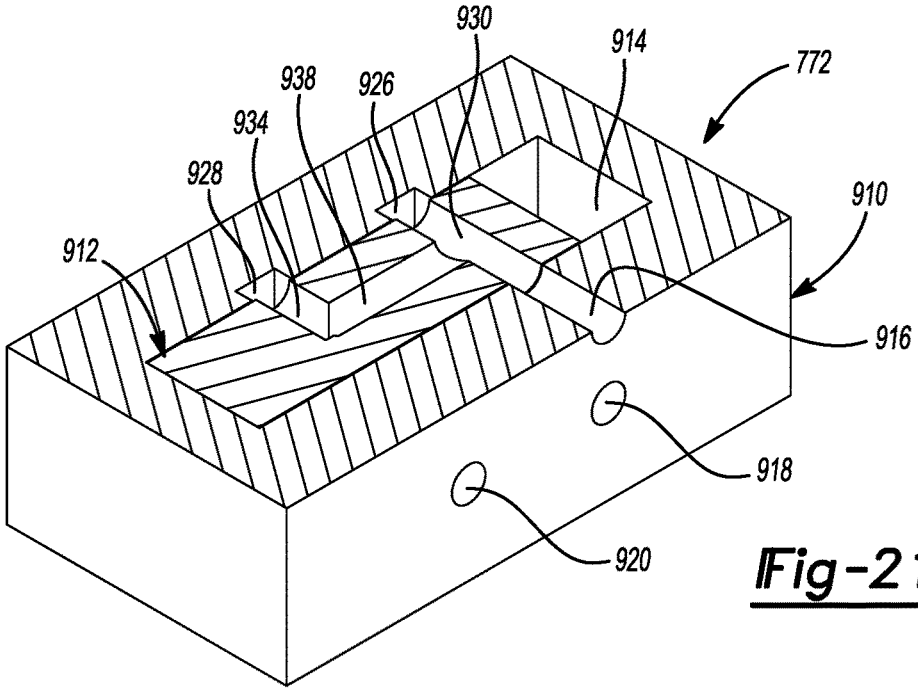
FIG. 21 is a cross-sectional view of the valve assembly of FIG. 17 in the second position.
Figure 22:
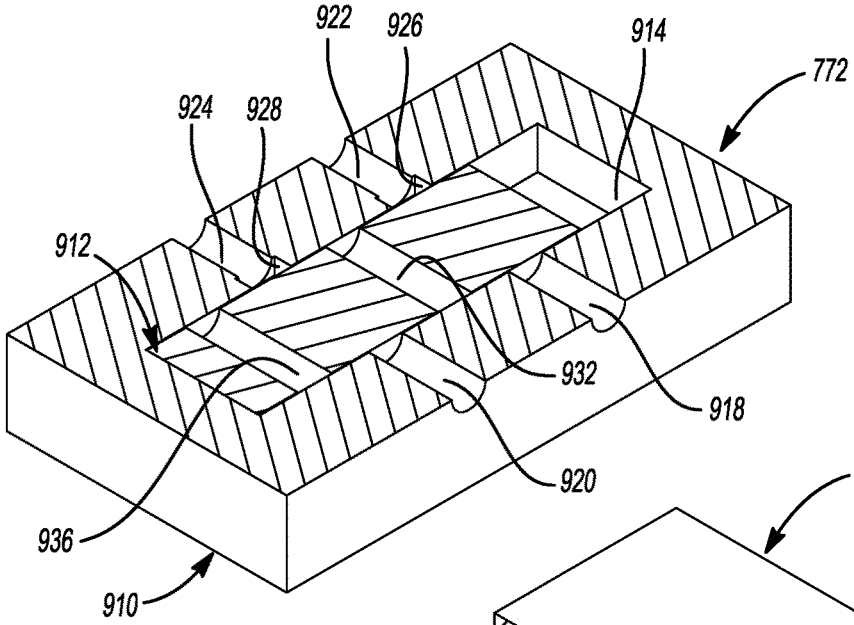
FIG. 22 is another cross-sectional view of the valve assembly of FIG. 17 in the second position.
Figure 23:
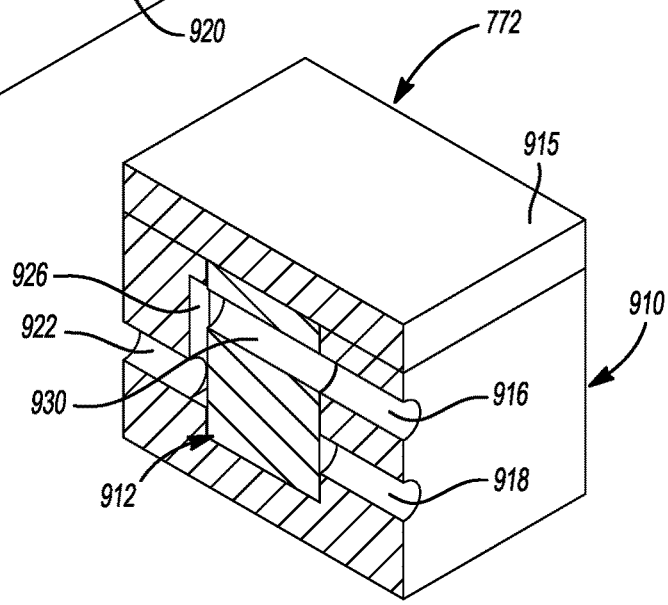
FIG. 23 is yet another cross-sectional view of the valve assembly of FIG. 17 in the second position.

As shown in FIGS. 21-23, when the valve member 912 is in the second position: (a) the first aperture 930 in the valve member 912 is in fluid communication with the first opening 916 in the valve body 910, and the first and third apertures 930, 934 in the valve member 912 are in fluid communication with the first and second recesses 926, 928 and the fourth and fifth openings 922, 924 in the valve body 910 (as shown in FIG. 21), thereby allowing fluid communication among the inner port 826, the axial biasing chamber 902 and the modulation control chamber 898; (b) the second aperture 932 in the valve member 912 is blocked from fluid communication with the second and fourth openings 918, 922 in the valve body 910 (as shown in FIG. 22), thereby blocking fluid communication between the outer port 824 and the axial biasing chamber 902; (c) the fourth aperture 936 in the valve member 912 is blocked from fluid communication with the third and fifth openings 920, 924 in the valve body 910, thereby blocking fluid communication between the modulation control chamber 898 and the suction-pressure region 106. By providing intermediate-pressure fluid from the inner port 826 to the modulation control chamber 898, the intermediate-pressure fluid in the modulation control chamber 898 forces the valve ring 854 axially away from the end plate 784 (toward the floating seal 820), to open the modulation ports 812, 814 to allow fluid communication between the modulation ports 812, 814 and the suction-pressure region 106 (as shown in FIG. 16).

In some configurations, the valve assembly 772 may be a MEMS (micro-electro-mechanical systems) valve assembly and may include a control module having processing circuitry for controlling movement of the valve member 912 between the first and second positions. In some configurations, the valve assembly 772 could be any other type of valve assembly, such as a solenoid, piezoelectric, or stepper valve, for example (i.e., the valve member 912 could be actuated by a solenoid, piezoelectric, or stepper actuator).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a first scroll including a first end plate and a first spiral wrap extending from the first end plate;

a second scroll including a second end plate and a second spiral wrap extending from the second end plate, the first and second spiral wraps meshing with each other and forming a plurality of compression pockets therebetween;

an axial biasing chamber disposed axially between the second end plate and a floating seal assembly, wherein the floating seal assembly at least partially defines the axial biasing chamber, wherein fluid within the axial biasing chamber biases the second scroll toward the first scroll; and a valve assembly in communication with the axial biasing chamber and movable between a first position providing fluid communication between a first pressure region and the axial biasing chamber and a second position providing fluid communication between a second pressure region and the axial biasing chamber, wherein the second pressure region is at a higher pressure than the first pressure region.

2. The compressor of claim 1, wherein the first pressure region is a first intermediate-pressure compression pocket defined by the first and second spiral wraps, wherein the second pressure region is a second intermediate-pressure compression pocket defined by the first and second spiral wraps, and wherein the second intermediate-pressure compression pocket is disposed radially inward relative to the first intermediate-pressure compression pocket.

3. The compressor of claim 1, wherein the first pressure region is a suction-pressure region.

4. The compressor of claim 1, wherein the second pressure region is a discharge-pressure region.

5. The compressor of claim 4, wherein the discharge-pressure region is a discharge passage extending through the second end plate.

6. The compressor of claim 1, wherein the first pressure region is a suction-pressure region, and wherein the second pressure region is a discharge-pressure region.

7. The compressor of claim 6, wherein the discharge-pressure region is a discharge passage extending through the second end plate.

8. The compressor of claim 6, wherein the second end plate includes a first passage and a second passage, wherein the first passage is open to a discharge passage and is in fluid communication with the valve assembly, and wherein the second passage is open to the axial biasing chamber and is in fluid communication with the valve assembly.

9. The compressor of claim 8, wherein the valve assembly provides fluid communication between the first passage and the second passage when the valve assembly is in the second position.

10. The compressor of claim 9, wherein the valve assembly provides fluid communication between the second passage and the suction-pressure region when the valve assembly is in the first position.

11. The compressor of claim 10, wherein:

the valve assembly includes a valve member movable between the first position and the second position, the valve member includes a first aperture and a second aperture, when the valve member is in the first position, communication between the first passage and the first aperture is blocked and the second aperture is in communication with the suction-pressure region, and when the valve member is in the second position, communication between the suction-pressure region and the second aperture is blocked and the first aperture is in communication with the first passage.

12. The compressor of claim 11, wherein the valve assembly is a MEMS microvalve.

13. The compressor of claim 1, further comprising a control module controlling operation of the valve assembly, wherein the control module pulse-width-modulates the valve assembly between the first and second positions to achieve a desired fluid pressure within the axial biasing chamber, and wherein the desired fluid pressure is determined based on operating conditions.

14. A compressor comprising:

an orbiting scroll including a first end plate and a first spiral wrap extending from the first end plate;

a non-orbiting scroll including a second end plate and a second spiral wrap extending from the second end plate, the first and second spiral wraps meshing with each other and forming a plurality of compression pockets therebetween;

an axial biasing chamber disposed axially between the second end plate and a component, wherein the component at least partially defines the axial biasing chamber, wherein fluid within the axial biasing chamber biases the non-orbiting scroll toward the orbiting scroll; and a valve assembly in communication with the axial biasing chamber, wherein the valve assembly includes a valve member that is movable between a first position providing fluid communication between a first pressure region and the axial biasing chamber and a second position providing fluid communication between a second pressure region and the axial biasing chamber, wherein the second pressure region is at a higher pressure than the first pressure region.

15. The compressor of claim 14, wherein the component is a floating seal assembly.

16. The compressor of claim 14, wherein the first pressure region is a first intermediate-pressure compression pocket defined by the first and second spiral wraps, wherein the second pressure region is a second intermediate-pressure compression pocket defined by the first and second spiral wraps, and wherein the second intermediate-pressure compression pocket is disposed radially inward relative to the first intermediate-pressure compression pocket.

17. The compressor of claim 16, wherein the second end plate includes a first passage, a second passage, and a third passage, wherein the first passage is open to the first intermediate-pressure pocket and is in fluid communication with the valve assembly, wherein the second passage is open to the second intermediate pressure pocket and is in fluid communication with the valve assembly, and wherein the third passage is open to the axial biasing chamber and is in fluid commination with the valve assembly, and wherein the valve assembly provides fluid communication between the first passage and the third passage when the valve member is in the first position, and wherein the valve assembly provides fluid communication between the second passage and the third passage when the valve member is in the second position.

18. The compressor of claim 14, wherein the first pressure region is a suction-pressure region, and wherein the second pressure region is a discharge-pressure region.

19. The compressor of claim 18, wherein the second end plate includes a first passage and a second passage, wherein the first passage is open to a discharge passage and is in fluid communication with the valve assembly, wherein the second passage is open to the axial biasing chamber and is in fluid communication with the valve assembly, wherein the valve assembly provides fluid communication between the first passage and the second passage when the valve member is in the second position, and wherein the valve assembly provides fluid communication between the second passage and the suction-pressure region when the valve member is in the first position.

20. The compressor of claim 19, wherein:

the valve member includes a first aperture and a second aperture, when the valve member is in the first position, communication between the first passage and the first aperture is blocked and the second aperture is in communication with the suction-pressure region, and when the valve member is in the second position, communication between the suction-pressure region and the second aperture is blocked and the first aperture is in communication with the first passage.

21. The compressor of claim 14, further comprising a control module controlling operation of the valve assembly, wherein the control module pulse-width-modulates the valve member between the first and second positions to achieve a desired fluid pressure within the axial biasing chamber, and wherein the desired fluid pressure is determined based on operating conditions.

* * * * *